US008978764B2

(12) United States Patent
Dusseault et al.

(10) Patent No.: US 8,978,764 B2
(45) Date of Patent: Mar. 17, 2015

(54) MULTI-STAGE FRACTURE INJECTION PROCESS FOR ENHANCED RESOURCE PRODUCTION FROM SHALES

(76) Inventors: Maurice B. Dusseault, Waterloo (CA); Roman Bilak, Calgary (CA)

( * ) Notice: Subject to any disclaimer, the term of this patent is extended or adjusted under 35 U.S.C. 154(b) by 0 days.

(21) Appl. No.: 13/578,810

(22) PCT Filed: Dec. 22, 2011

(86) PCT No.: PCT/CA2011/050802

§ 371 (c)(1),
(2), (4) Date: Aug. 13, 2012

(87) PCT Pub. No.: WO2012/083463

PCT Pub. Date: Jun. 28, 2012

(65) Prior Publication Data

US 2013/0284438 A1 Oct. 31, 2013

Related U.S. Application Data

(60) Provisional application No. 61/426,131, filed on Dec. 22, 2010, provisional application No. 61/428,911, filed on Dec. 31, 2010.

(51) Int. Cl.

| | |
|---|---|
| ***E21B 43/26*** | (2006.01) |
| ***E21B 43/267*** | (2006.01) |
| ***E21B 47/00*** | (2012.01) |

(52) U.S. Cl.

CPC ..... *E21B 43/26* (2013.01); *E21B 43/267* (2013.01)

USPC ..... 166/308.1; 166/250.1; 166/280.1

(58) Field of Classification Search

USPC ..... 166/400, 271, 280.1, 280.2, 166/308.1–308.6, 177.5

See application file for complete search history.

(56) References Cited

U.S. PATENT DOCUMENTS

| | | | | |
|---|---|---|---|---|
| 3,050,119 | A * | 8/1962 | Fast et al. | 166/308.1 |
| 3,372,752 | A | 3/1968 | Prater | |
| 3,917,345 | A | 11/1975 | Davidson et al. | |
| 4,220,205 | A * | 9/1980 | Coursen et al. | 166/299 |

(Continued)

FOREIGN PATENT DOCUMENTS

| | | | | |
|---|---|---|---|---|
| WO | 2008004172 | A2 | 1/2008 | |
| WO | WO 2010/021563 | * | 2/2010 | E21B 43/267 |

OTHER PUBLICATIONS

Schlumberger Oilfield Glossary entries for "pad" and "staged fracturing", accessed on Aug. 23, 2013 via www.glossary.oilfield.slb.com.*

(Continued)

*Primary Examiner* — Blake Michener
(74) *Attorney, Agent, or Firm* — Patterson & Sheridan LLP

(57) ABSTRACT

The invention relates to a method of generating a network of fractures in a rock formation for extraction of hydrocarbon or other resource from the formation. The method includes the steps of i) enhancing a network of natural fractures and incipient fractures within the formation by injecting a non-slurry aqueous solution into the well under conditions suitable for promoting dilation, shearing and/or hydraulic communication of the natural fractures, and subsequently ii) inducing a large-fracture network that is in hydraulic communication with the enhanced natural fracture network by injecting a plurality of slurries comprising a carrying fluid and sequentially larger-grained granular proppants into said well in a series of injection episodes.

16 Claims, 26 Drawing Sheets

(56) References Cited

U.S. PATENT DOCUMENTS

| | | | | |
|---|---|---|---|---|
| 4,549,608 | A | 10/1985 | Stowe et al. | |
| 5,875,843 | A * | 3/1999 | Hill | 166/250.1 |
| 7,210,528 | B1 * | 5/2007 | Brannon et al. | 507/140 |
| 7,472,751 | B2 * | 1/2009 | Brannon et al. | 166/280.1 |
| 7,918,277 | B2 * | 4/2011 | Brannon et al. | 166/280.2 |
| 8,127,850 | B2 * | 3/2012 | Brannon et al. | 166/308.1 |
| 2004/0211567 | A1 * | 10/2004 | Aud | 166/308.1 |
| 2006/0131031 | A1 * | 6/2006 | McKeachnie et al. | 166/376 |
| 2006/0157243 | A1 * | 7/2006 | Nguyen | 166/280.2 |
| 2007/0215345 | A1 * | 9/2007 | Lafferty et al. | 166/250.1 |
| 2009/0107674 | A1 * | 4/2009 | Brannon et al. | 166/280.2 |
| 2009/0301731 | A1 * | 12/2009 | McDaniel et al. | 166/372 |
| 2010/0059226 | A1 * | 3/2010 | Termine et al. | 166/308.1 |
| 2011/0120702 | A1 * | 5/2011 | Craig | 166/250.1 |
| 2011/0120705 | A1 * | 5/2011 | Walters et al. | 166/270 |
| 2011/0120718 | A1 * | 5/2011 | Craig | 166/308.1 |
| 2011/0180259 | A1 * | 7/2011 | Willberg et al. | 166/280.2 |
| 2011/0180260 | A1 * | 7/2011 | Brannon et al. | 166/281 |
| 2013/0014951 | A1 * | 1/2013 | Fitzpatrick | 166/305.1 |
| 2013/0105157 | A1 * | 5/2013 | Barmatov et al. | 166/280.1 |

OTHER PUBLICATIONS

Dictionary definitions of "granular" and "granule", accessed Feb. 11, 2014 via thefreedictionary.com.*

Dictionary definitions of "adequate" and "sufficient", accessed Jul. 7, 2014 via thefreedictionary.com.*

Schlumberger Oilfiield Glossary entry for "fracturing pressure", accessed Jul. 7, 2014 via www.glossary.oilfield.slb.com.*

International search report for application No. PCT/CA2011/050802 dated Mar. 27, 2012.

* cited by examiner

MULTI-STAGE FRACTURE INJECTION PROCESS FOR ENHANCED RESOURCE PRODUCTION FROM SHALES

CROSS REFERENCE TO RELATED APPLICATIONS

This application is a National Phase of PCT application No. PCT/CA2011/050802, filed on Dec. 12, 2011, and claims benefit of U.S. provisional patent application Ser. No. 61/426,131, filed on Dec. 22, 2010 and U.S. provisional patent application Ser. No. 61/428,911 filed Dec. 31, 2010. Each of the aforementioned related patent applications is herein incorporated by reference.

FIELD OF THE INVENTION

The present invention relates to extraction of hydrocarbons or other resource such as geothermal energy from a shale or other low-permeability naturally fractured formation, by hydraulic fracturing.

BACKGROUND OF THE INVENTION

Large quantities of extractable hydrocarbons exist in subsurface shale formations and other low-permeability strata, such as the Monterey Formation in the United States and the Bakken Formation in the United States and Canada. However, extraction of hydrocarbons from certain low-permeability strata at commercially useful rates has proven to be a challenge from technical, economic and environmental perspectives. One approach for extracting hydrocarbons from shale and other low permeability rocks has been to induce the formation of large scale massive fractures through the use of an elevated hydraulic pressure acting on a fluid in contact with the rock through a wellbore. However, this is often accompanied by serious environmental consequences such as a large surface "footprint" for the necessary supplies and equipment, as well as relatively high costs. As well, concerns have been expressed regarding the potential environmental impact from the use of synthetic additives in hydraulic fracturing solutions. These financial and other factors have resulted in difficulties in commercial hydrocarbon extraction from shale oil beds and other low permeability strata. In general, conventional hydraulic fracturing or "fracking" methods generate new fractures or networks of fractures in the rock on a massive scale, and do not take significant advantage of the pre-existing networks of naturally occurring fractures and incipient fractures that typically exist in shale formations.

A typical shale formation or other low-permeability reservoir rock comprises the matrix rock intersected by a network of low conductivity native or natural fractures 10 and fully closed incipient fractures 12 extending throughout the formation, as depicted in FIG. 1. FIG. 1 is a two-dimensional depiction of a three-dimensional fracture network in a rock mass with a low-permeability matrix. It is understood that in reality there are many three-dimensional effects, and that the rock mass is acted upon by three orthogonally oriented principal compressive stresses, but in FIG. 1 only the maximum and the minimum far-field compressive stresses—$\sigma_{HMAX}$ 14 and $\sigma_{hmin}$ 16 respectively, acting in the cross-section are represented. The natural fractures 10 and planes of weakness typically exist in a highly networked configuration with intersections between the fractures, and usually but not always with certain directions having more fractures than others, depending on past geological processes. In their natural state, some of the fractures may be open to permit flow, but in most cases require stimulation. The majority of fractures are almost fully closed or are not yet fully formed fractures. These are "incipient" fractures which can be turned into open fractures by appropriate stimulation treatments during injection. The relative stiffness and the geological history of the rock engenders the natural formation of the network of actual and incipient fractures. The natural fractures 10 are mostly closed as a result of the elevated compressive stresses acting on the rock as depicted in FIG. 1, and because the rock mass has not been subjected to any bending or other deformation. In their closed state, fractures provide little in the way of a pathway for oil, gas or water to flow towards a production well. When closed, fractures do not serve a particularly useful role in the extraction of hydrocarbons or thermal energy.

In prior art fracture processes, sometimes referred to as "high rate fracturing" or "frac-n-pack", a fracture fluid which usually comprises a granular proppant and a carrying fluid, often of high viscosity, is injected "wellbore" 18 into the injection well 19 at a high rate, for example in the range of 15-20 or more barrels per minute bpm. As depicted in FIGS. 2 and 3, this process tends to generate relatively fat fractures that propagate outwardly from the wellbore 18 of the injection well 19. In a typical sandstone reservoir, the process creates a dominantly bi-directional fracture orientation with the major induced fractures oriented at ~90° to the smallest stress in the earth, depicted as the primary fractures 20 FIG. 2. Secondary fractures 22 may form to a limited extent, as seen in FIG. 2. The fluid generating the fracture is gradually dissipated across the walls of the fracture planes in the direction of the maximum pressure gradient as fracture fluid downgradient leak-off 24 (FIG. 2). In prior art high proppant concentration methods employing viscous fluids with extremely high contents of granular proppant (FIG. 3), said proppant also tends to be forced between the wellbore 18 and the rock 21 under a high hydraulic fracture rate, to create a zone 23 of proppant fully or substantially fully surrounding the injection well 19. This provides good contact with the induced fractures 11 and connecting with the primary 20 and secondary 22 fractures emanating from the region of the wellbore 18 (FIG. 2). The large size of the hydraulic fracture wings 28 interacts with the natural stress fields 30 FIG. 2 so that it is necessary to inject at a pressure substantially above the minimum far-field compressive stresses $\sigma_{hmin}$ 14 (FIGS. 1 and 2), and in prior art it has been described as necessary to co-inject a relatively large amount of proppant suspended within the viscous fluid to maintain the induced fractures 11 in an open and permeable state once the high injection pressures are ceased. The fracture patterns which result from at least some prior art processes are characterized by a relatively limited bi-directional fracture orientation, with relatively poor volumetric fracture sweep because of a limited number of fracture arms. The efficiency of interaction between the created fractures and the natural fracture flow system within the formation is believed to be low in such cases, and the lowest efficiency is associated with hydraulically induced fractures 11 of thin aperture and consisting only of two laterally opposed wings with no secondary fractures.

In certain prior art fracturing processes, liquids are deliberately made more viscous through the use of gels, polymers and other additives so that the proppants can be carried far into the fractures, both vertically and horizontally. Furthermore, in said prior art fracturing, extremely fine-grained particulate material may be added to the viscous carrier fluid to further block the porosity and reduce the rate of fluid leak off to the formation so that the fracture fluids can carry the proppant farther into the induced fracture. Prior art fracturing is typically designed as a continuous process with no interruptions in injection and no pressure decay or pressure build-up tests i.e., PFOT, SRT carried out within the process to evaluate the stimulation effects upon the natural fracture 10 network or the flow nature of the generated interconnected extensive fracture network. Prior art fracturing processes typically do not shut down, and in some realizations, increase the proppant concentration in a deliberate process intended to create short fat fractures.

SUMMARY OF THE INVENTION

The present invention relates to the use of relatively lower fracture injection rates, longer term injection, and multi-stage and cyclic episodes of fracturing a target formation with water and proppant slurry—called slurry fracture injection "SFI"™—in order to create a large fracture-influenced volume to enhance the extraction of resources such as oil, gas or thermal energy from the formation. In one aspect, the fracturing fluids employed in the process comprise water, saline or water/particulate slurries that are essentially free of additives. In one aspect, the invention relates to processes for generating hydraulic fractures and hydraulically enhancing the natural fracturing of the formation in a manner which accelerates and improves the extraction of hydrocarbons or thermal energy. The invention further relates to systems and methods for generating and enhancing the aperture and conductivity within a network of natural fractures and induced fractures within a subsurface formation that comprises a pre-existing natural fracture system and an induced hydraulic fracture system, in particular within shale, marl, siltstone or other low-permeability formation, by the sequential injections of In one aspect, the invention specifically seeks to maximize the volume change in a large region around the injection point so as to induce large changes in stress in a large volume of the rock mass surrounding the stimulation site, leading to opening of natural fractures, shearing of natural fractures, and developing incipient fractures into actual open fractures. A suitable target formation is shale, although it is contemplated that the method described herein or variants thereof may be adapted for use in any other low permeability rock type.

According to one aspect, the invention relates to a method of generating an enhanced and interconnected network of fractures within a rock formation, including but not limited to shale, that renders the rock mass more suitable for the economical extraction of a hydrocarbon or heat from the formation. A hydrocarbon-containing formation comprises a matrix rock that contains in its porosity substantial amounts of natural hydrocarbons and a network of natural fractures that vary from open to fully closed or incipient in nature. The method comprises in general terms the steps of providing at least one injection well extending into said formation and a source of pressurized water and proppant slurry for injection into said injection well at pressures and conditions suitable for inducing hydraulic fracturing of the said formation, and performing the following stages in sequence:

Stage 1: injecting a particulate-free aqueous solution into injection well 19 under conditions suitable for dilating, shearing offsetting the fracture faces and thereby enhancing the natural fracture network in said formation; and extending the enhanced natural fracture network in said formation. Preferably, the aqueous solution is additive-free water or aqueous saline solution. The solution may not contain particulate matter of any type and that will not precipitate mineral matter in the rock fractures or porosity.

Stage 2: injecting a slurry comprising a carrying fluid and a fine-grained granular proppant into said injection well, under conditions suitable for further extending and propping the natural fracture network that has been opened, enhanced, and interconnected by the actions delineated in stage 1, which may be carried out to such an extent that a large volume change has been permanently generated by the opening, shearing, and propping of natural fractures to the maximum practical economic extent, in order to engender stress changes in the surrounding rock.

Stage 3: injecting a slurry comprising a coarse-grained granular proppant into said injection well, under conditions suitable to fully connect with the stage 2 sand-propped region and to generate, prop and extend newly induced fractures to interact with the enhanced natural fracture network produced in stage 2 and stage 1; and also further enhance the enhanced natural fracture network produced in stage 2 by generating concentrated volume changes that favour continued opening and shear of the natural fractures, and the creation and extension of new fractures through the opening of incipient fracture planes in the far-field away from the wellbore.

In the above process, one may optionally repeat any one of the stages multiple times before proceeding to the next stage. As well. One may repeat any pair of stages 1 and 2 or 2 and 3 before proceeding to the next stage. As well, the entire cycle of stages 1-3 may be repeated multiple times.

In one aspect, stage 2 follows stage 1 with essentially no time gap therebetween.

Stage 2 or 3 may comprise a sequence of discrete sand injection episodes separated by water injection episodes or by periods of no injection. The method may further comprise a plurality of cycles comprising stages 1 through 3, with shut-in periods without injection between said cycles. The method may further comprise a plurality of cycles with periods in between cycles where pressures are allowed to dissipate before recommencing injection. Any one of stages 1-3 may be repeated multiple times before proceeding to the subsequent stage, if any.

DEFINITIONS

Figure 1:
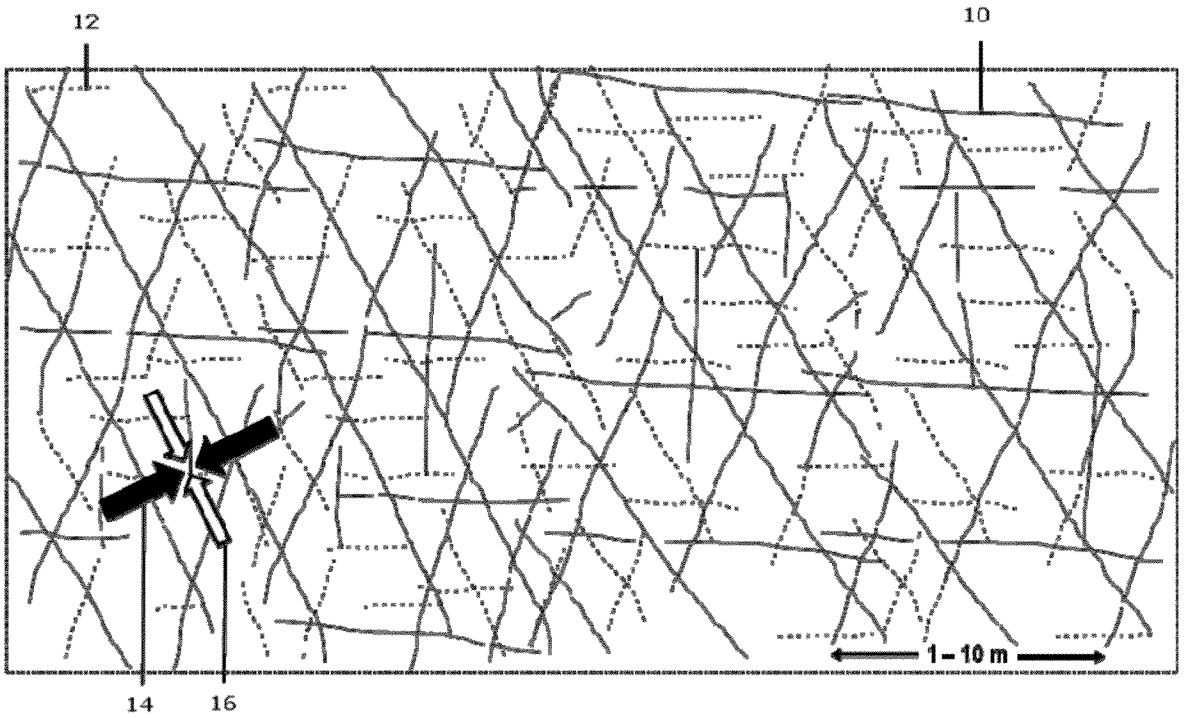
FIG. 1 is a schematic depiction of a cross-section of a shale formation.

The term "formation" as used herein means: a layer or limited set of adjacent layers of rock in the subsurface that is a target for commercial exploitation of contained hydrocarbons or other resource and therefore may be subjected to stimulation methods to facilitate the development of that resource. It is understood that the resource can be hydrocarbons, heat, or other fluid or soluble substance for which an interconnected fracture network can increase the extraction efficiency.

The terms "Slurry Fracture Injection" and interchangeably "SFI" are trademarks, and as used herein refer to a process comprising the injection of a pumpable slurry consisting of a blend of sand/proppant with mix water into a formation at depth under in situ fracturing pressures, employing cyclic injection strategies, long term injection periods generally on the order of 8-16 hrs/day for up to 20-26 days/month, and using process control techniques during injection to: optimize formation injectivity, maximize formation access, and maintain fracture containment within the formation.

The term "fracture" as used herein means: a crack in the rock formation that is either naturally existing or induced by hydraulic fracturing techniques. A fracture can be either open or closed.

The term "enhanced" as used herein means: an improvement in the aperture, fluid conductivity, and/or hydraulic communication of a fracture that is either natural or induced by hydraulic fracturing techniques.

"Natural fractures" or interchangeably "native fractures" as used herein mean: surfaces occurring naturally in the rock formation i.e., not man-made that are fully parted although they may be in intimate contact or surfaces that are partially separated but normally remain in intimate contact and are considered planes of weakness along which fully open fractures can be created.

The term "incipient fracture" means: a natural fracture that is fully closed and incompletely formed in situ but that is a plane of weakness in parting and can be opened and extended through the application of appropriate stimulation approaches such as SFI™.

The terms "induced fracture" or "generated fracture" as used herein mean: a fracture or fractures created in the rock formation by man-made hydraulic fracturing techniques involving or aided by the use of a hydraulic fluid, which in the present process is intended to be clear water along with additives such as friction reducers to aid the hydraulic fracturing process.

The term "slurry" as used herein means: a mixture a granular material sand/proppant along with clear water, which may or may not have additional additives for friction control and fracture development control.

The term "proppant" refers to a solid particulate material employed to maintain induced fractures open once injection has ceased, generally consisting of a quartz sand or artificially manufactured particulate material in the size range of 50 to 2000 microns 0.002 to 0.10 inches in diameter. Herein, the words proppant and sand are usually employed interchangeably.

The abbreviation PFOT means Pressure Fall-Off Test

The abbreviation SRT means Step-Rate Test

The intended meanings of other terms, symbols and units used in the text and figures are those that are generally accepted in the art, and additional clarifications are given only when the use of such terms deviates significantly from commonly accepted meanings.

DESCRIPTION

FIG. 1 is a schematic depiction of a cross-section of a shale formation, showing natural (native) fractures 10 in a substantially closed state and incipient fractures 12. The depiction is oriented as a horizontal cross-sectional plane of a three-dimensional rock mass, and in the depiction, the two principal far-field compressive stresses acting orthogonally along the plane of the cross-section. The maximum and the minimum far-field compressive stresses are termed $\sigma_{HMAX}$ and $\sigma_{hmin}$ respectively, depicted as arrows 14 and 16. The depicted orientation of these two principal far-field compressive stresses is not intended to represent any preferred direction, but is simply a representation of said stresses. It is understood that in a three-dimensional rock mass, there exist three of said compressive stresses, different from each other, acting orthogonally upon the rock mass. In general, the natural fractures 10 are kept closed or compressed by said far-field compressive stresses.

Figure 2:
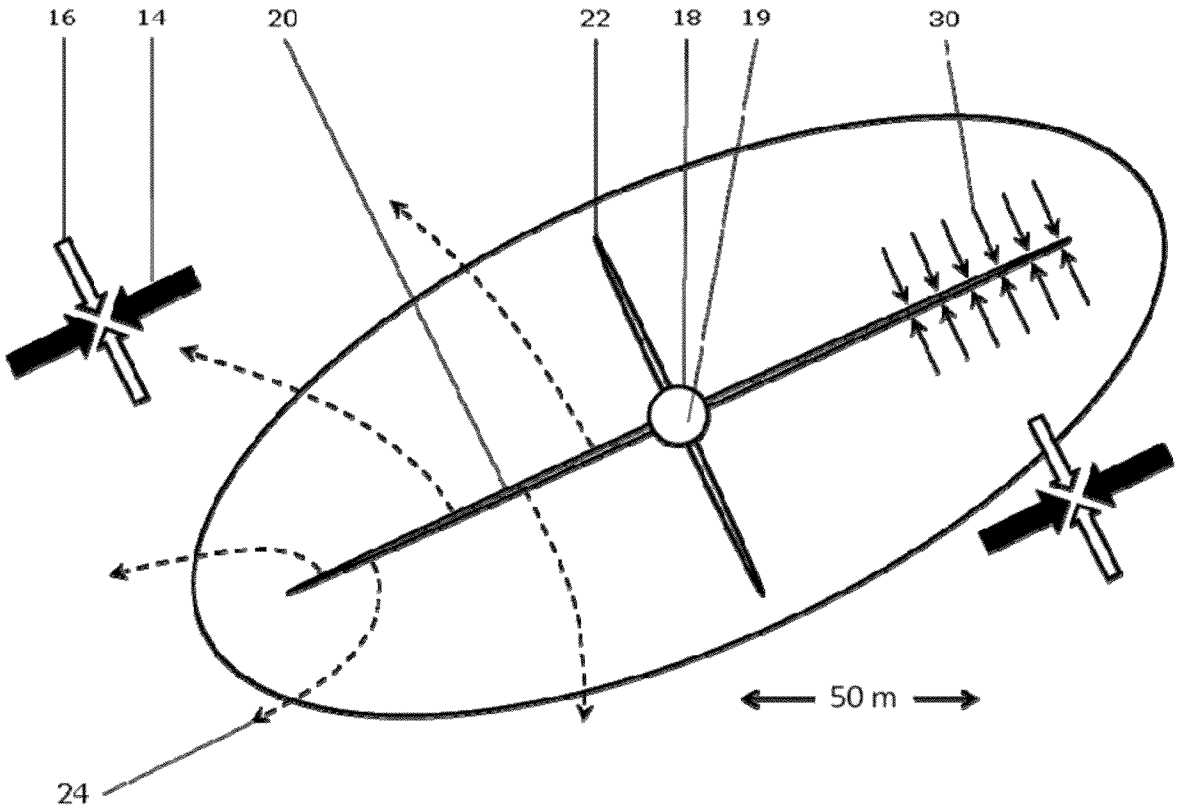
Figure 2 (Prior Art)
FIG. 2 is a schematic view of a cross-section of a hydraulically fractured formation generated according to a prior art method.

FIG. 2 is a cross-sectional depiction of a hydraulically fractured formation generated according to a prior art method, showing typical primary fractures 20 and secondary fractures 22 which may also contain within them placed deposits of proppant extending far within the formation following the planar openings generated by the hydraulic fracturing process. The thickness of the induced and propped fracture planes is exaggerated for demonstration purposes; in stiff rocks under large compressive stresses, they are rarely more than 10-20 mm thick. Fracturing is generated by fluids pumped into the formation through wellbore 19 of well 18.

Figure 3:
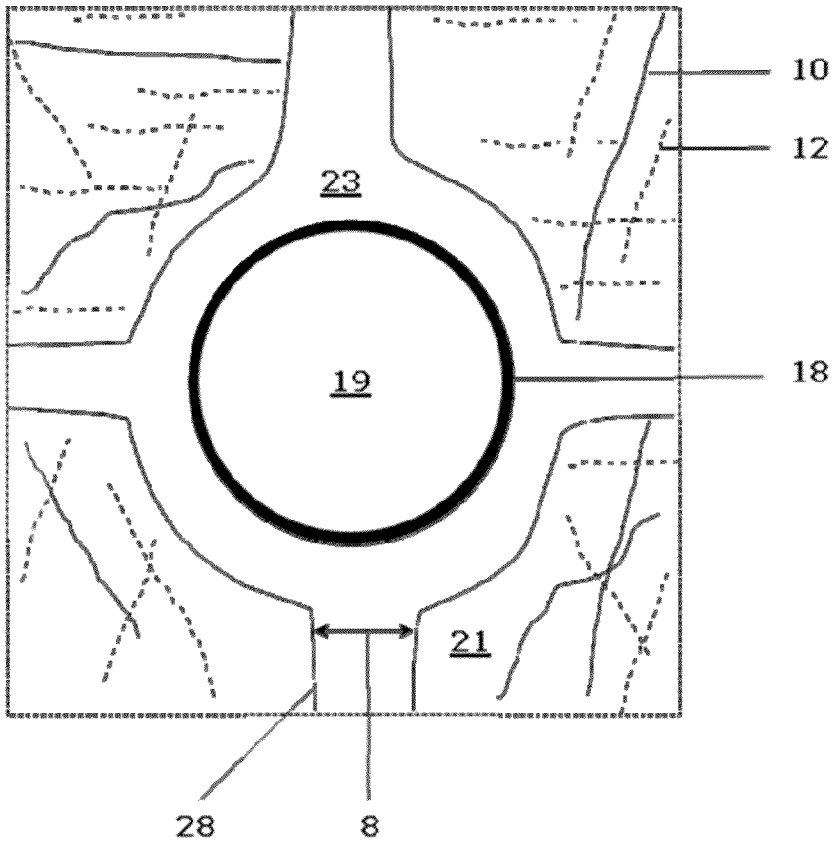
Figure 3 (Prior Art)
FIG. 3 is a further schematic view of a cross-section of a hydraulically fractured formation generated according to a prior art method.

FIG. 3 is a cross-sectional depiction of a prior art fractured formation in the near-wellbore region, showing the creation of a zone 23 of proppant fully or substantially fully surrounding the wellbore 18 of well 19 and in the part of the induced fractures 8 near the wellbore 18, showing the communication between the wellbore 18 and the induced fractures 8.

Figure 4:
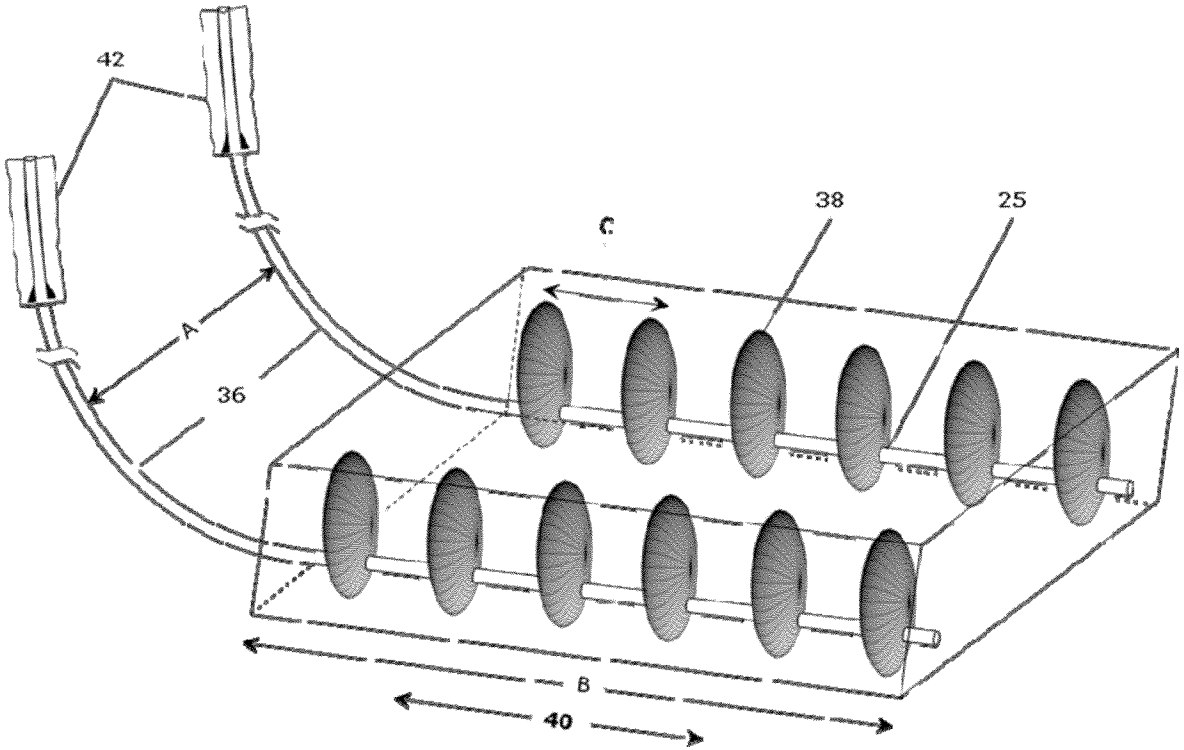
FIG. 4 is a depiction of subsurface formations depicting wells emplaced therein according to an embodiment of the present invention.

FIG. 4 is a depiction of subsurface formations, with a pair of horizontal or near-horizontal injection wells 19, or injection wells 19 parallel to the strata dip, with typical spacing ranging between each injection well 19 of 50 to 500 meters A, although it is understood that this is a typical range, and in practice other dimensions may be required. Each injection well 19 has been subjected to a series of hydraulic fracture injection stimulations 38 along its length. Each wellbore is a cemented-in-place steel casing 36 of suitable diameter. Typical length of the well is about 500 to 2000 meters, with inter-well spacing of about 50 to 300 meters C. These are typical ranges of well lengths and spacing, and in practice other values may be required. At sites selected and spaced along the length of the horizontal section in the target formation, a perforated site 25 is created in the steel casing. Then, at each perforated site, a hydraulic fracture injection stimulation has been implemented. Each hydraulic fracture injection stimulation involves a number of stages performed in a low permeability target formation such as a shale or siltstone. The dilated zone 38 that is affected in terms of natural fracture dilation and induced fracture placement is generally in the three-dimensional configuration of an ellipsoid of which the narrow axis is oriented parallel to the minimum stress direction in situ $\sigma_3$ (40). It is understood that the choice of a horizontal or near-horizontal well orientation in this figure does not precludes the use of the present method in vertical or inclined wells, which may be preferred in some circumstances such as unusual stress fields, pre-existing steel-cased wells, unavailability of horizontal well drilling capability, and so on.

FIG. 4 also depicts a cemented surface casing 42 providing extra protection to the existing shallow groundwater against any accidental interaction of the fracturing fluid with the shallow formations.

Figure 5:
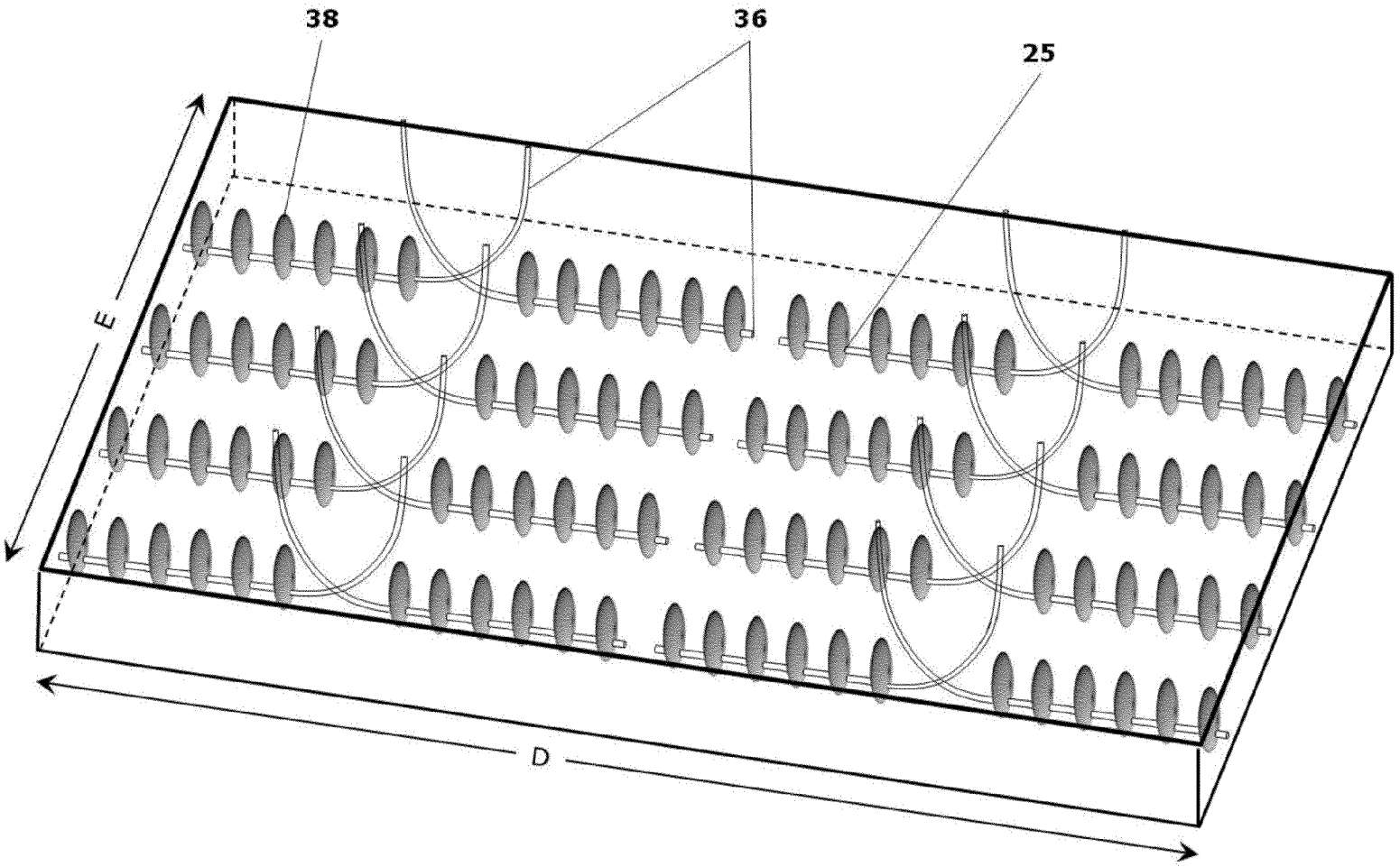
FIG. 5 is a further depiction of subsurface formations depicting wells emplaced therein according to an embodiment of the present invention.

FIG. 5 depicts subsurface formations, showing a much more extensive array of injection wells 19 to provide coverage of a reservoir. In one non-limiting example, wells 19 are about 3000 to 6000 meters in length with inter-well spacings of about 50 to 300 meters. There are multiple dilated zones 38 along the axis of each injection well 19, with each dilated zone 38 being treated according to the method described herein to generate a stimulated volume comprising both the region of sand injection into natural fractures 10 and the surrounding region within which the natural fracture system has been enhanced by the present process through increases in aperture because of stress changes induced through the present process.

Figure 6A:
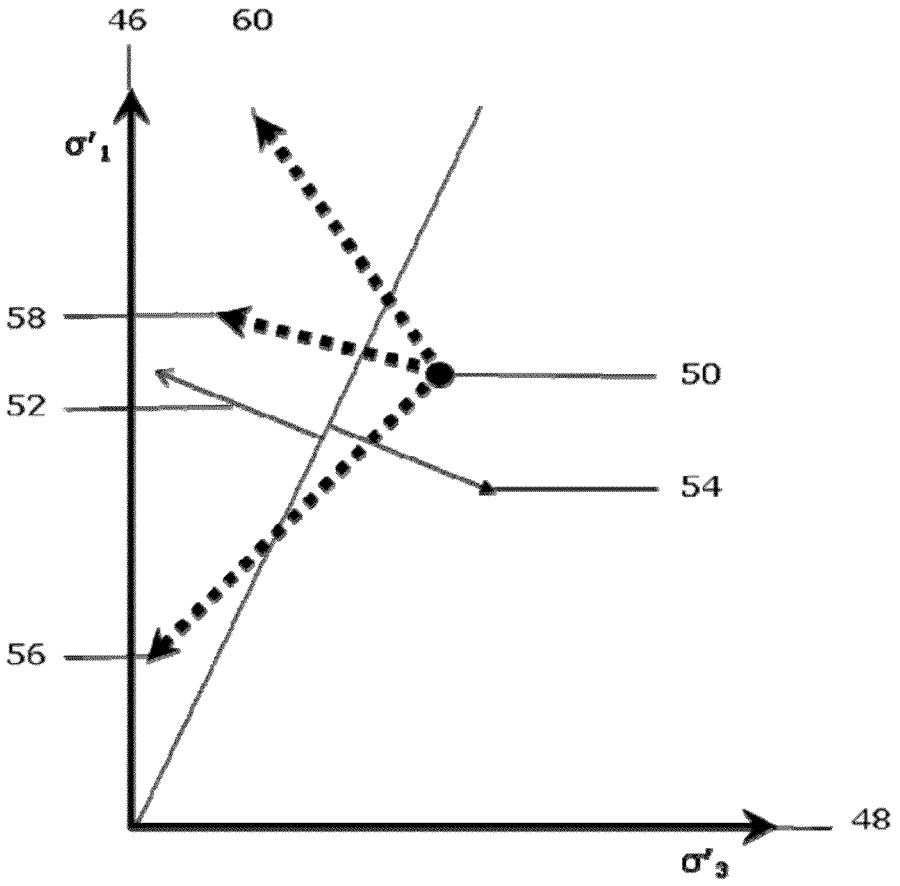
FIGS. 6A and 6B are schematic cross-sectional configurations of a formation showing an embodiment of the invention.
Figure 6B:
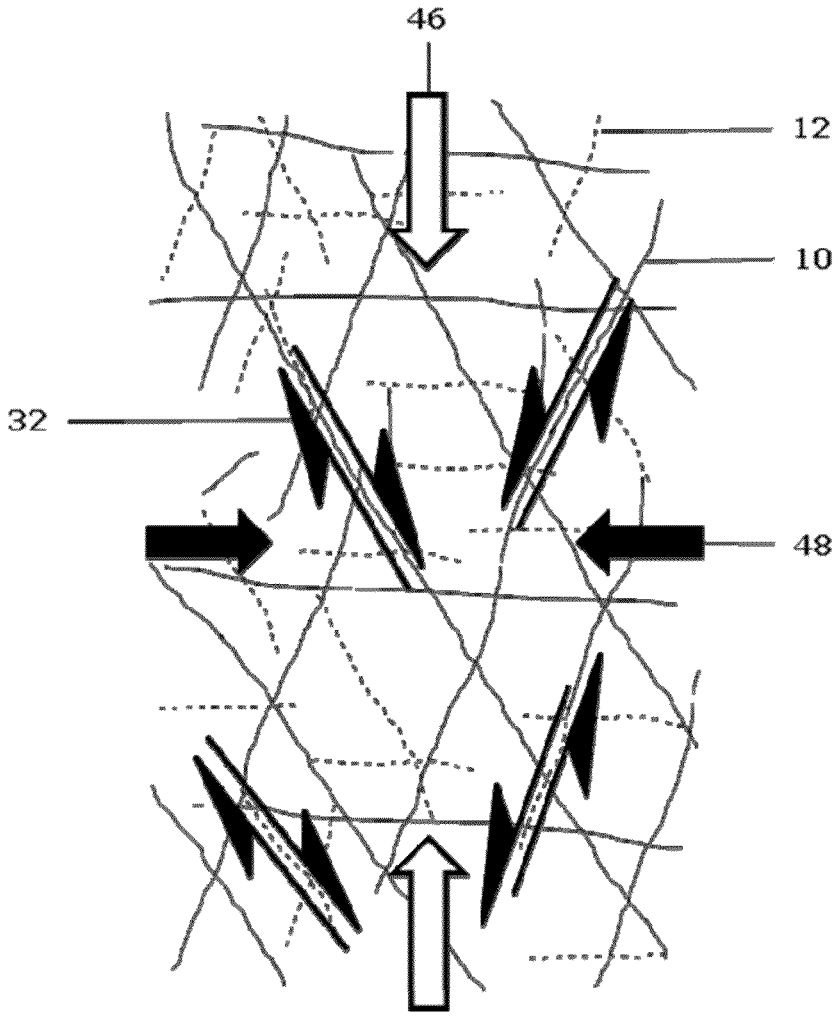

FIGS. 6A and 6B depict typical stress changes and resulting shearing within a formation during the application of the present method. FIG. 6A depicts the tendency to shear and is plotted on a principal effective stress axis where $\sigma'_1$ and $\sigma'_3$ represent the greatest and the least principal effective stress, respectively, the orientation of which is not stipulated. FIG. 6A depicts the typical initial stress state 50, as well as stress conditions defined as the shear slip regions 52 where shearing will take place and the no shear slip region 54 where shearing does not occur. The term effective stress is widely known by person skilled in the art to refer to the difference between the global compressive stress in a given direction and the pore pressure, such that when the pore pressure becomes equal or greater than the compressive stress in that direction, conditions suitable for natural fracture 10 opening or shear 32 are reached. Typical stress paths to achieve the slip condition are a path to shear slip with increasing pore pressure by injection 56, a path to slip with decreasing $\sigma'_3$ 58 and a path to slip with increasing $\sigma'_1$ and decreasing $\sigma'_3$ (FIG. 6A). FIG. 6B depicts suitably oriented natural fractures 10 in the rock mass will exhibit shear 32 displacement once the stresses and pressures on that natural or incipient shear plane have reached critical conditions for slip. FIG. 6B depicts a relatively large number of such planes in a rock mass, thereby indicating that a suitably designed and executed fracture stimulation treatment by the proposed method will activate many such planes.

Figure 7A:
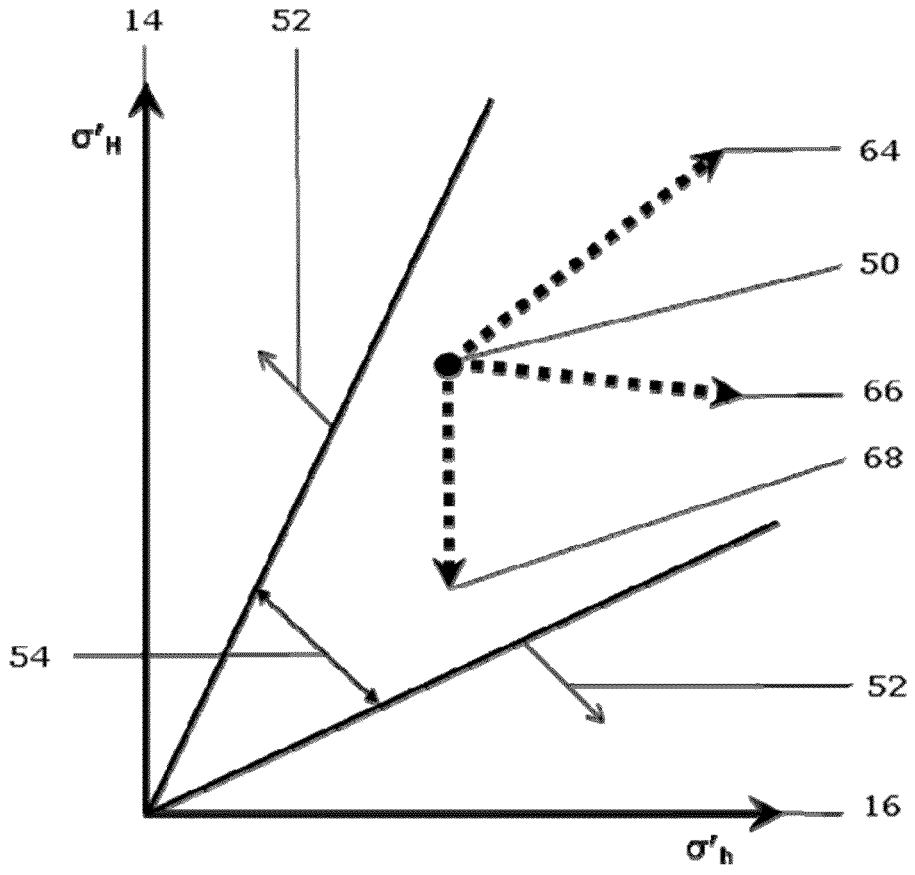
FIGS. 7A and 7B are schematic cross-sectional configurations of forces within a formation in an embodiment of the invention.
Figure 7B:
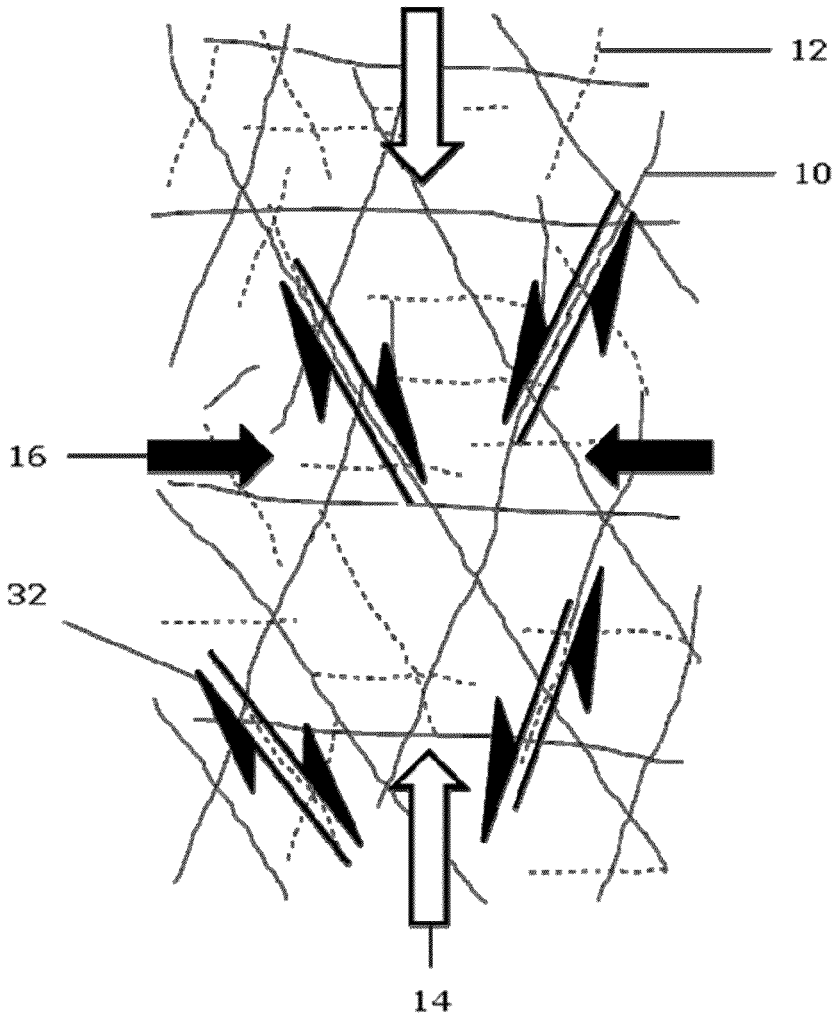

FIGS. 7A and 7B depict alternative shearing responses within the formation. FIG. 7A depicts effective compressive stress in the original direction of the maximum $\sigma'_H$ and the minimum $\sigma'_h$ far-field stresses, which fixes the diagram to represent, as the chosen example, a horizontal planar cross-section. Typical stress paths are a no-slip path from decreasing the pore pressure withdrawal 64, a path to slip with increasing $\sigma'_h$ and a path to slip with decreasing $\sigma'_H$ (FIG. 7A). A decrease in the pore pressure due to withdrawal does not lead to a condition of opening or shear displacement. The central wedge is thereby, in this depiction of the process, as a stable "no shear" slip region 54 within which shear slip does not occur. The depicted stress paths are intended to demonstrate that there are many stress paths that may not lead to shear slip, or that are improbable stress paths for shear and dilation. This depiction is intended to demonstrate the vital importance of rock mechanics principles in understanding and implementing the present method. Large changes in the stresses and pore pressures in a naturally fractured system act on fractures in specific orientations and assist opening these fractures by increasing the parting pressure or cause shear displacement along the fractures by a combination of increasing pore pressure and stress changes, both processes tending to increase the permeability of the rock mass.

Figure 8A:
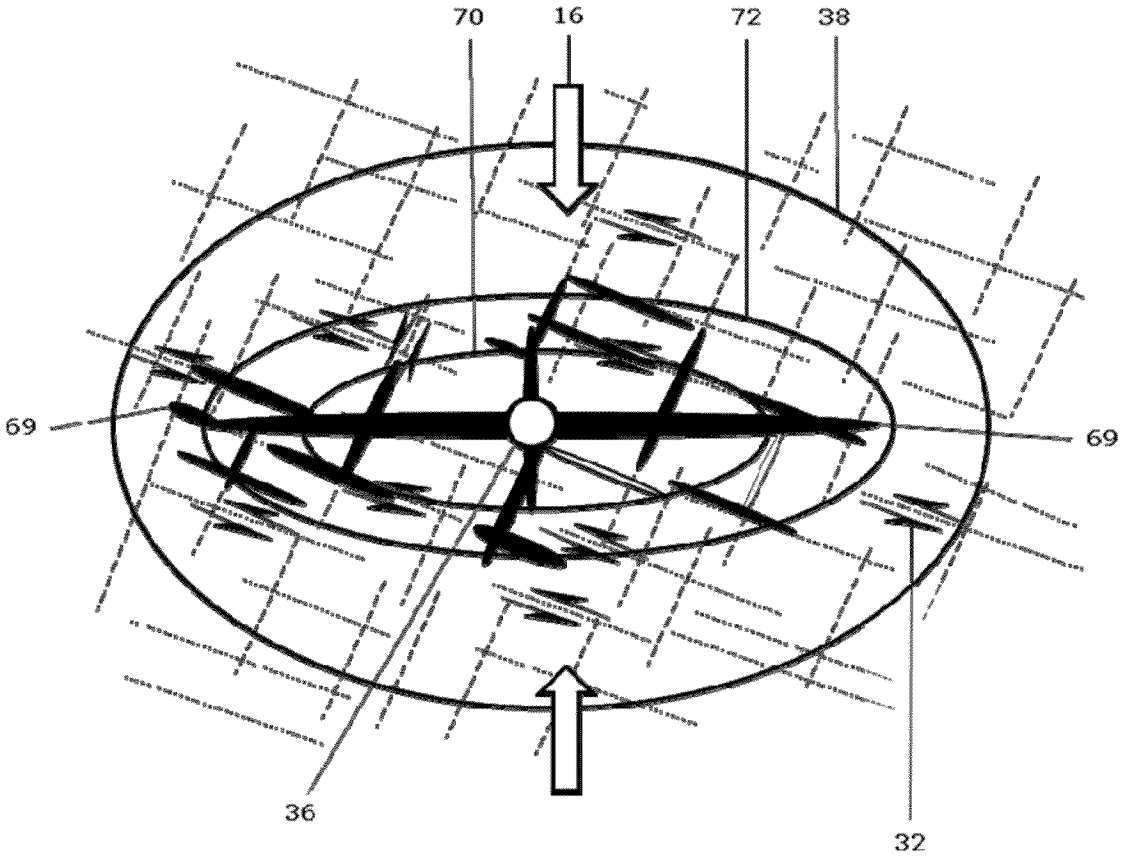
FIGS. 8A through 8C are schematic cross-sectional configurations of a formation showing an embodiment of the invention.
Figure 8B:
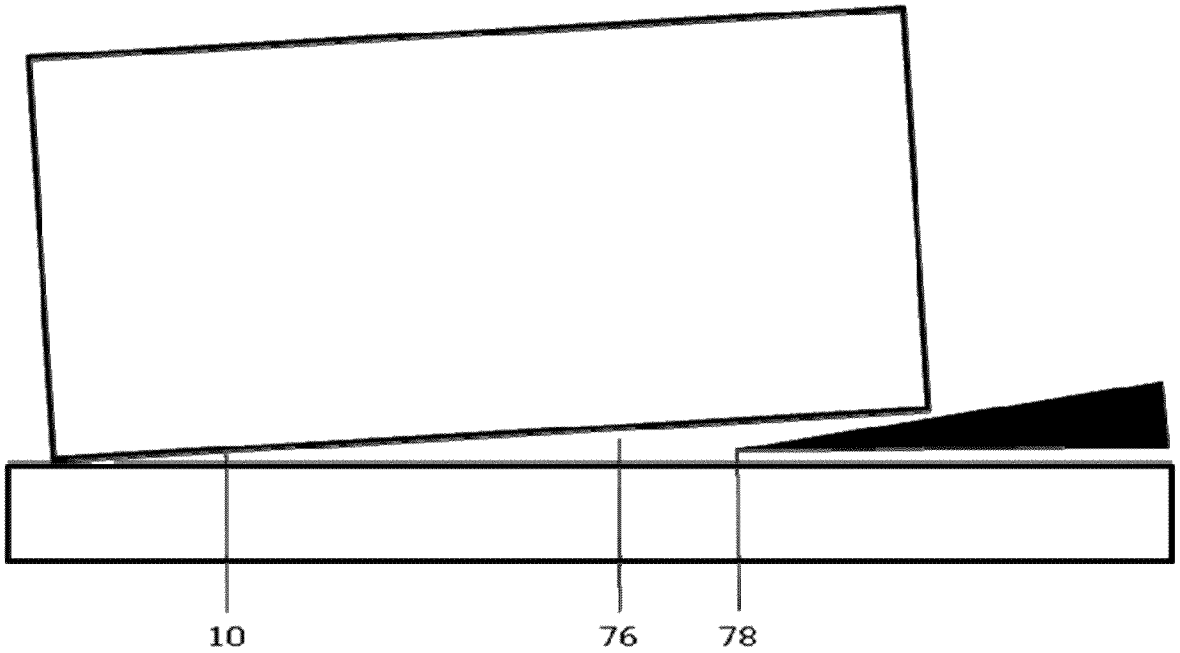
Figure 8C:
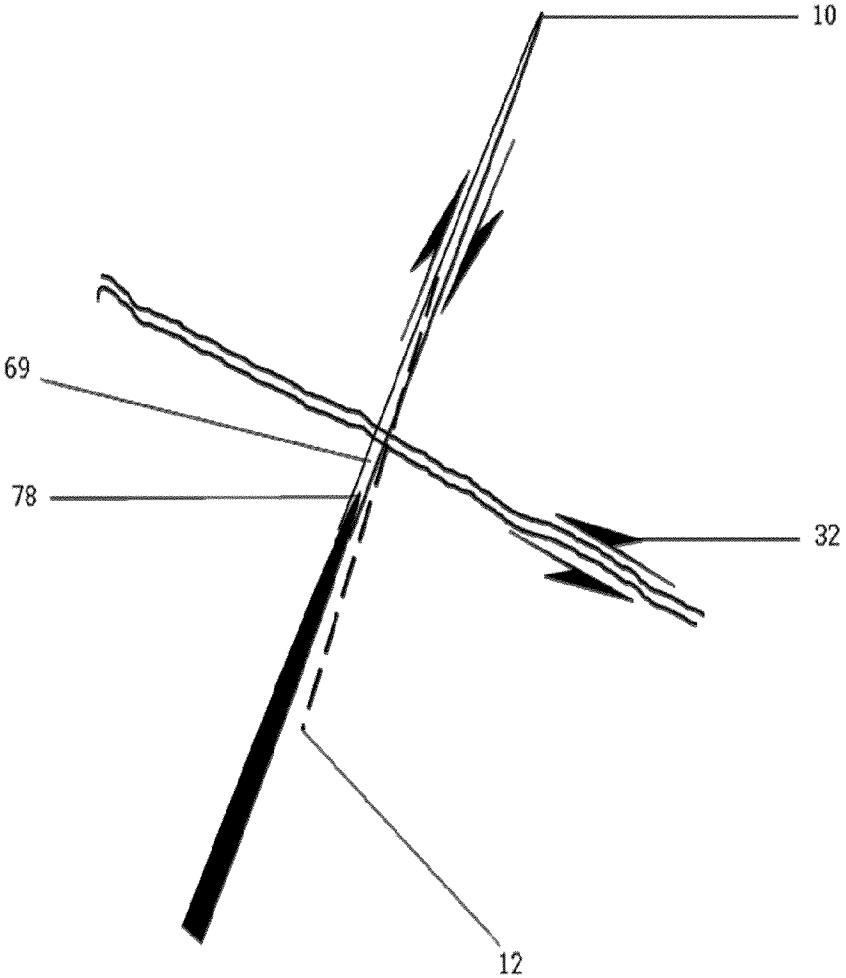

FIG. 8A is across-sectional depiction of a shale formation, showing a network of natural fractures 10 that have been wedged and sheared to become open natural fractures 69 as a result of the changes in volume and changes in stresses and pressures afforded by the suitable placement of sand in induced fractures 8 designed and implemented by the method of specially staged injection activities described herein as per stages 1, 2 and 3. In this case, the diagram depicts a vertical wellbore 36 accessing the formation, and it is understood that this is only a depiction, and that any orientation of well may in principle be used. Surrounding the wellbore 36 is a roughly ellipsoidal stage 3 zone 70 that defines the region within which the coarse-grained sand has been explicitly placed in stage 3 of the present process. Surrounding the stage 3 zone 70 is a much larger volume stage 2 zone 72 within which the fine-grained sand placed in stage 2 of the present process extends. Surrounding the stage 2 zone is a much larger volume zone to which the propping agent has not reached, called the dilated Zone 38. The dilated zone 38 in fact refers to the aggregate of the entire volume that has benefited from the process, whether or not the propping agent is actually within said opened natural fractures 69. The dilated volume is roughly ellipsoidal in shape with its narrowest axis parallel to the far-field minimum principal compressive stress direction, and it is the region within which fluids can move more easily because of an enhanced permeability arising from the application of the present method. By virtue of the large changes in stress and pressure deliberately induced by the present process, many of the natural fractures 10 have had their apertures significantly increased by processes such as high pressure injection, wedging, shear, and also through the small rotations of the rock blocks not shown in reaction to the large volume changes that are being enforced during all stages. The stimulated natural fractures will in general extend significant distances beyond the sand tip 78 by processes such as wedging FIG. 8B, and by hydraulic parting and shear FIG. 8C. Specifically, FIG. 8B depicts how forcing sand into a fracture 76 will wedge open and extend natural fractures 10 far from the sand tip 78. FIG. 8C further depicts a hydraulic fracture and a proppant wedge interacting with natural fractures 10, wedging some to become open natural fractures 69, and causing some of them to undergo shear 32 displacement, which also increases the aperture. Finally, it is noted that although the opened natural fractures 69 containing sand are depicted by thin ellipses, such networks are actually the hydraulically opened networks of natural fractures and hydraulically opened incipient fractures that have been partially filled with the proppant.

Figure 9A:
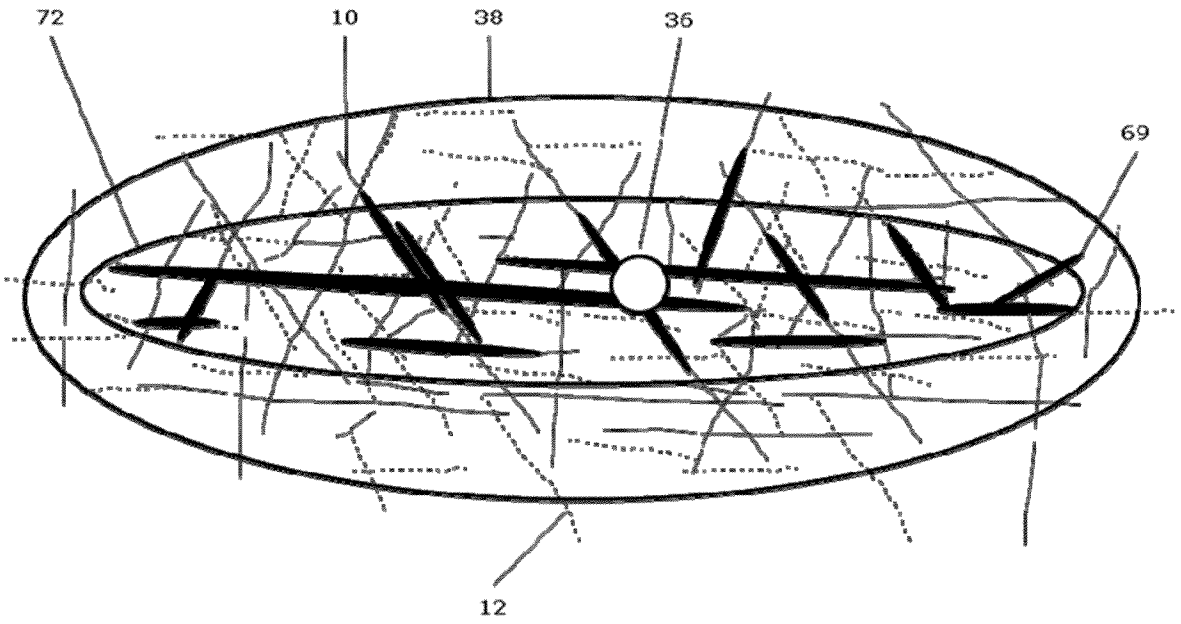
FIGS. 9A and 9B are further schematic cross-sectional configurations of a formation showing an embodiment of the invention.
Figure 9B:
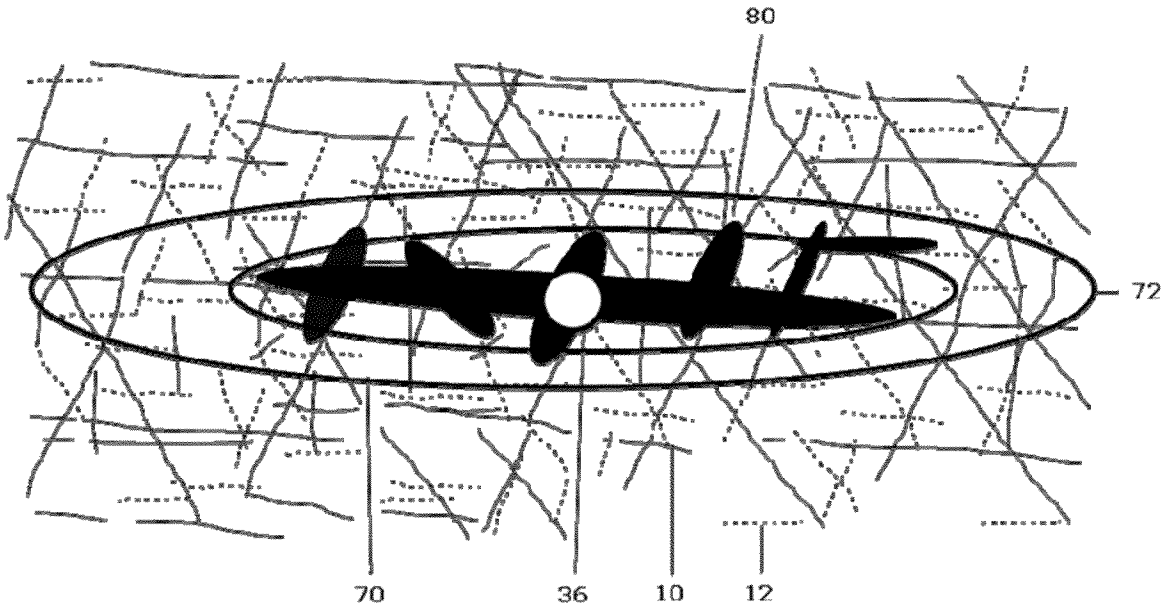

FIG. 9 depicts the results of a typical stimulation process using the present method. FIG. 9A depicts said stimulation after stage 2, although it is understood that the dilated zone 38 extends far beyond the elliptical region delineating the stage 2 sand zone 72 to access more formation. FIG. 9A depicts fractures emplaced and propped in different orientations, which is governed by the orientations and existence of the natural fracture system. In some directions the high injection pressures have parted the natural fractures 10 to become open natural fractures 69, and in different orientations shearing took place, as depicted in FIGS. 6, 7 and 8, giving rise to further enhancement and sand ingress. The larger the stress changes and the displacements, the more effective this process. Because in stage 2 fine-grained sand is employed (FIG. 9A), the propped fractures may be viewed as relatively thin and long, compared to the propped fractures generated in stage 3 (FIG. 9B), with less near-well volume change $\Delta V$. Stage 3 stimulation uses coarse-grained sand which is more rapidly deposited in a process called sand zone "packing", whereby large distortions and displacements are generated on the surrounding rock mass including the volumes stimulated by stage 1 and 2 injection processes, leading to more near-well $\Delta V$ and increasing $\Delta\sigma'$, triggering wedging and shear dilation of natural fractures 10 to become open natural fractures 69, and opening and extension of incipient fractures 12. In FIG. 9B, packed fractures 80 are depicted to lie entirely within the volume of the stage 2 sand zone 72, and in fact these stage 3 packed fractures may be induced fractures and/or the same natural fractures that were wedged and sheared to become open natural fractures 69 in previous stages, only now they are being aggressively packed with sand to give a high permeability region around the wellbore 36 as well as the large distortions that lead to shear and rock block rotation. In the present method, the injection procedures and the evaluations periodically carried out may be employed in an optimal manner, changing the methods and concentrations, to achieve the best possible stimulation for the sand and water volumes placed into a low-permeability formation.

Figure 10:
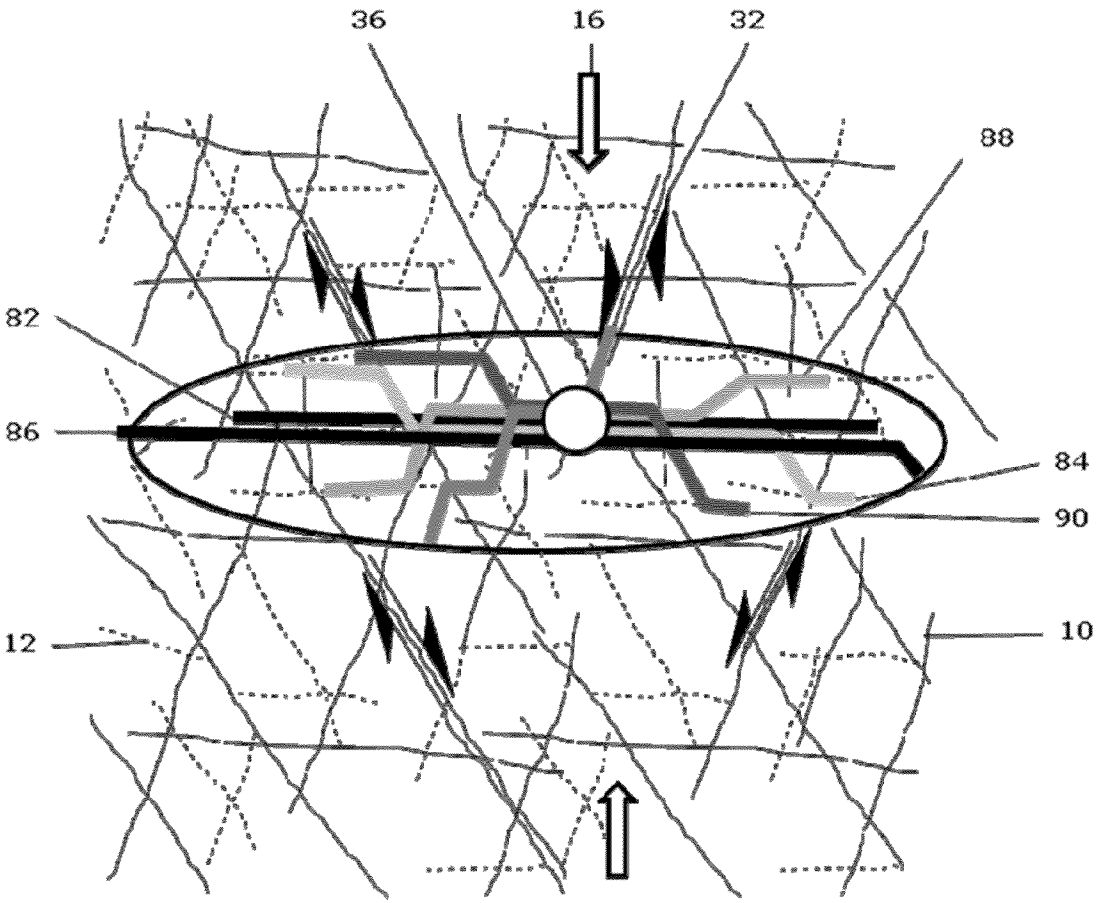
FIG. 10 is a further schematic cross-sectional configuration of a formation showing an embodiment of the invention.

FIG. 10 depicts how the present method described herein leads to propping of the natural fractures 10 in different orientations because of the stress changes deliberately induced in the region of the fracture placement zone during all stages. A fracture 82 is followed in time by generation of a new orientation fracture 84, then followed by further new orientation fractures 86, 88, 90 as coarse-grained granular proppant is carried into the formation during stage 3. Each fracture plane increases the volume change and widens the apertures of the natural fracture network, and this in turn leads to further stress changes and higher pressure in the local formation, such that there are additional stresses generated and pore pressures increased along fractures that are suitably oriented, causing shearing, wedging and dilation of the rock mass surrounding the sand-filled fracture zone. The different fracture orientations i.e., 82, 84, 86, 88, 90 are intended to depict that this process is not the generation of entirely new fracture planes within the rock mass, but a stimulation of the existing natural fractures 10 and incipient fractures 12 that are always found in stiff, low-permeability strata.

Figure 11:
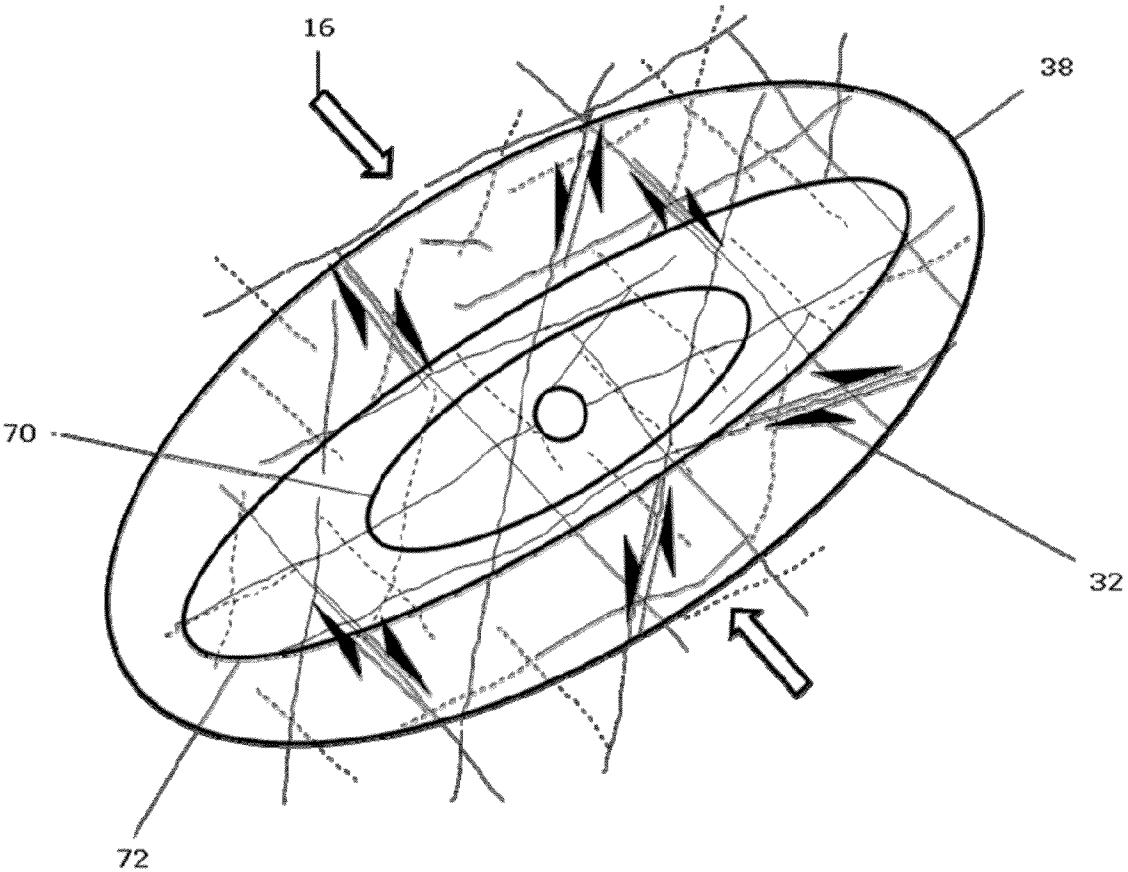
FIG. 11 is a further schematic cross-sectional configuration of a formation showing an embodiment of the invention.

FIG. 11 is a more general depiction following stage 3 showing the dilated zone 38, the sand zones of stage 2 (72) and stage 3 (74), and the shearing of appropriately oriented fracture planes in the surrounding rock mass, leading to a stimulated volume comprising both the sand and the dilated zone 38. Sand injection into the sand zones during stage 2 and stage 3 create a much larger dilated zone 38 surrounding the sand zone. Although not depicted for clarity, the physical nature of the induced shearing process following stage 3 causes natural fractures 10 to become open natural fractures 69, while others shear and dilate permanently self-propping. The open natural fractures 69 do not close when $\Delta p$ approaches zero, but are still sensitive to $\Delta p$ during depletion.

Figure 12:
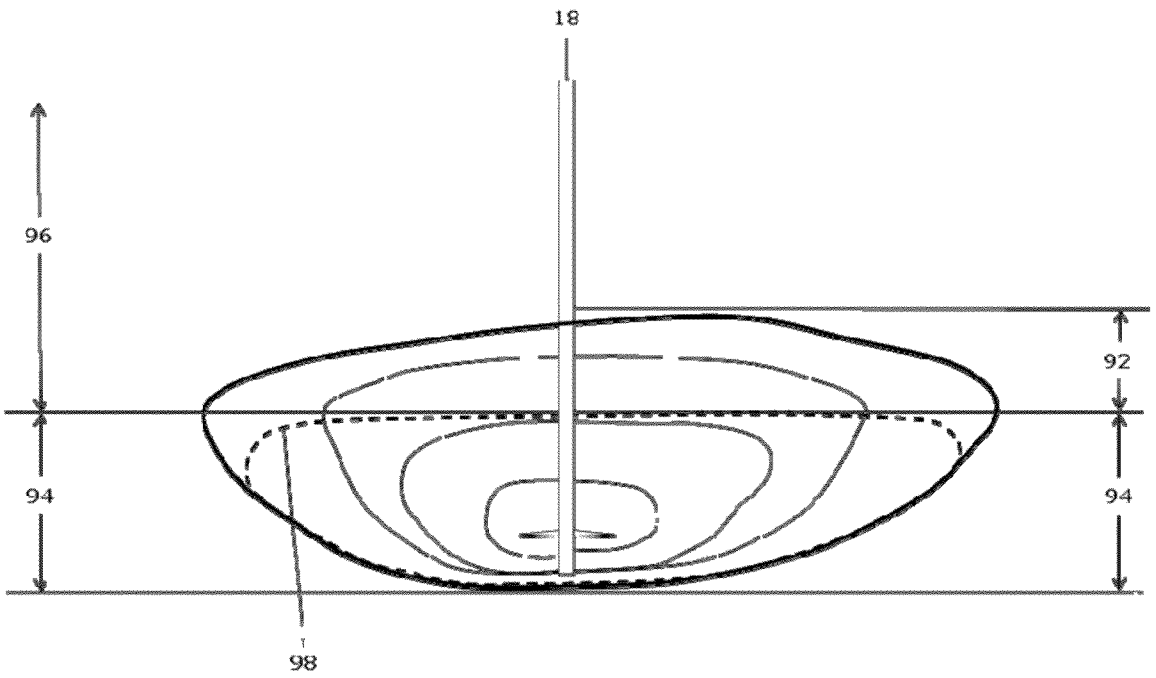
FIG. 12 is a further schematic cross-sectional configuration of a formation showing an embodiment of the invention.

FIG. 12 depicts the phenomenon known as fracture rise, which arises because the density of the clear water used as the fracture liquid is less than the horizontal stress gradient in the rock mass, therefore non-target zone fractures 92 tend to rise out of the target zone 94 into the non-target zone 96. However, in the method described herein, the sand carried in the clear liquid settles as the water rises 98, and this tends to keep the sand from rising into the non-target zone 96 where the presence of sand has no desirability because of the lack of hydrocarbons. Accordingly, the sand tends to stay within the target zone 94 being stimulated. It is part of one aspect of the present process that this tendency to avoid placing sand too high in vertical directions can be controlled through the fracture operations rate, pressure, sand concentration, episodic nature thereby ensuring maximum distribution of the injected sand and induced in situ volume change within the stimulated zone of interest, as is typical of the SFI process, in contrast to prior art. In this depiction, the presence of natural fractures 10 has been omitted merely for clarity.

Figure 13:
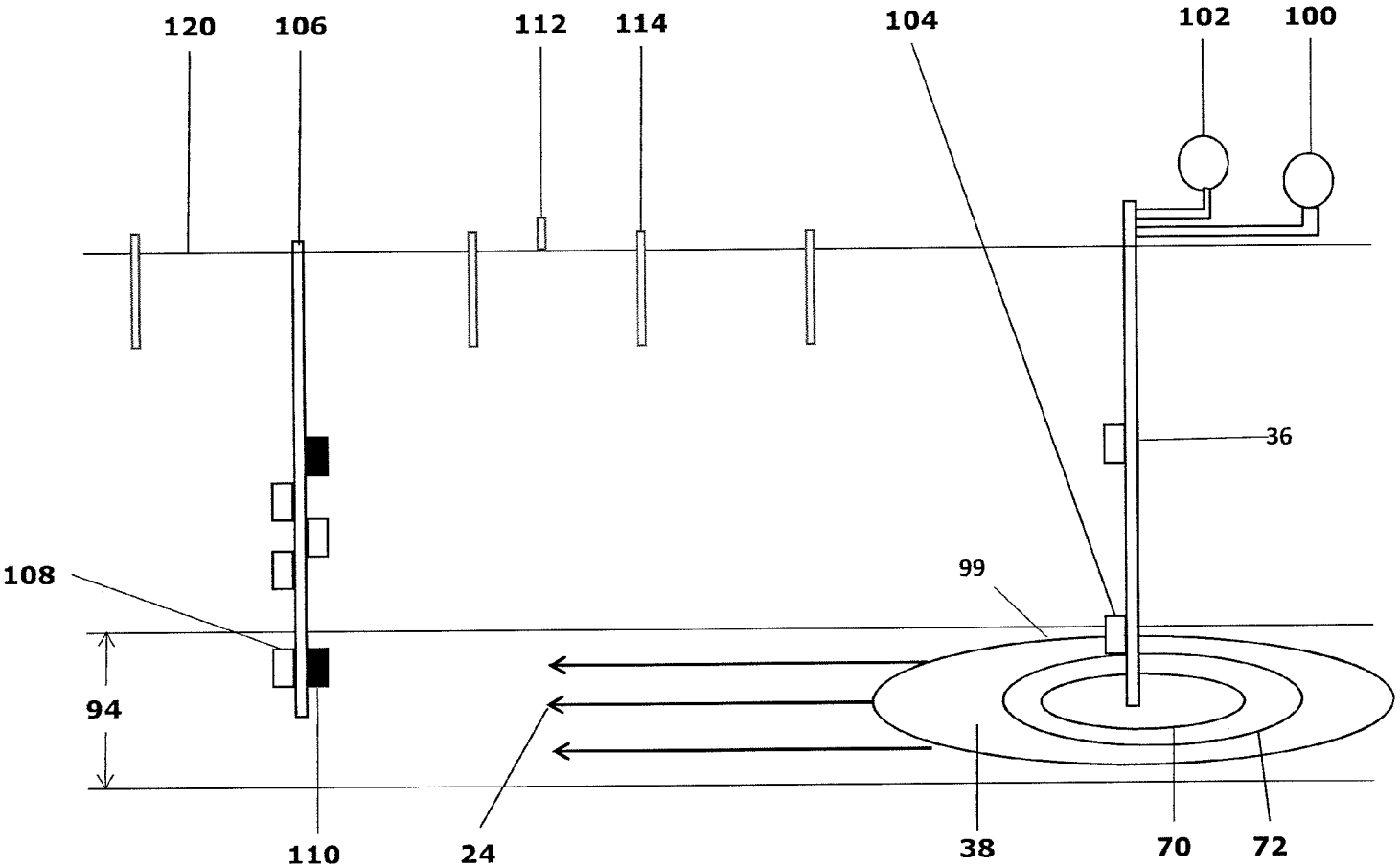
FIGS. 13 and 14 are schematic views showing methods of gathering microseismic and deformation data according to the invention.
Figure 14:
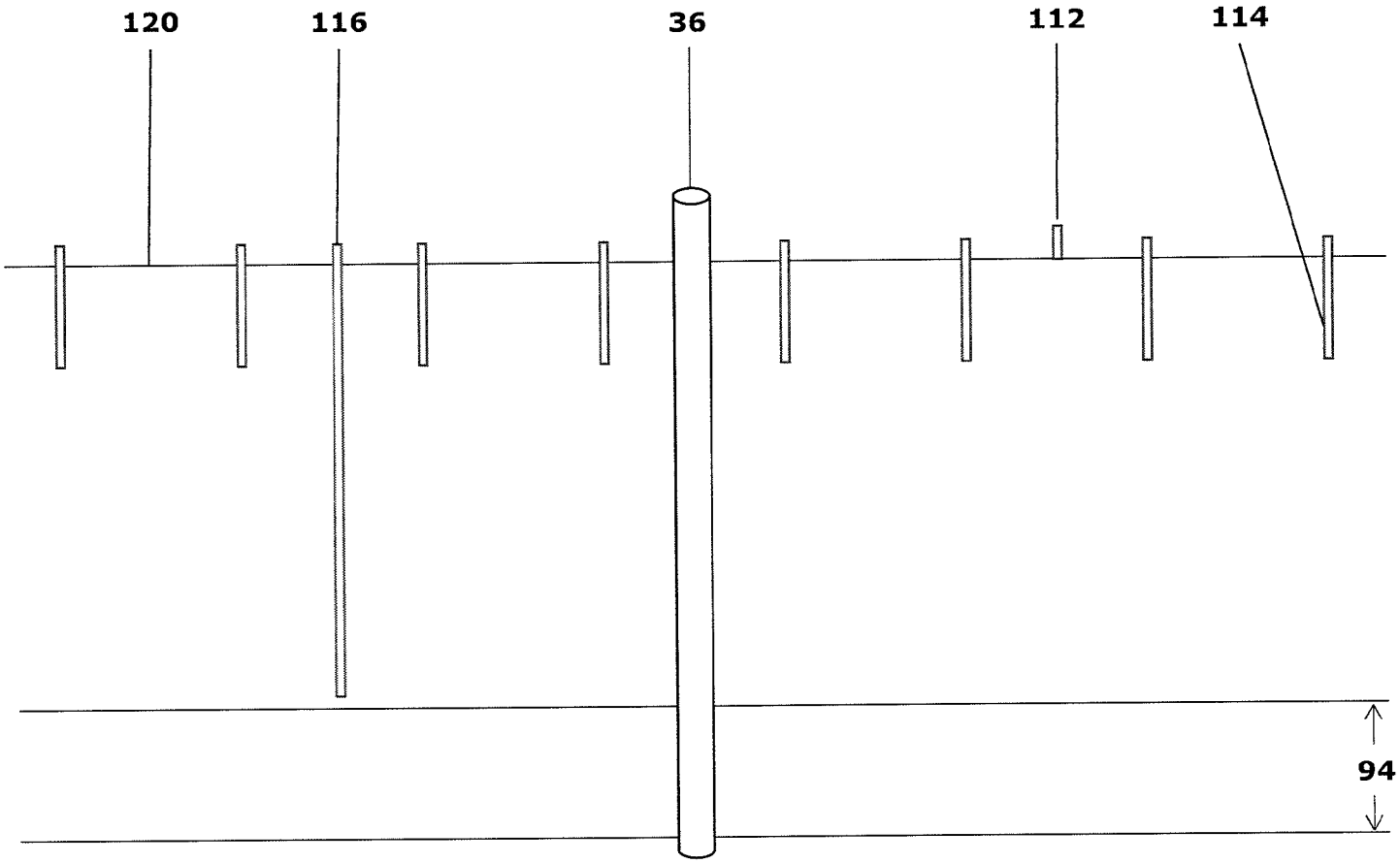

FIGS. 13 and 14 depict methods of gathering microseismic and deformation data to help track the location and volume changes in the rock mass that may be used in the method described herein. Specifically, the availability of monitoring capability in the nature of pressure and rate monitoring, used to track the fracturing process while active injection is going on, but also to evaluate the nature of the altered zone after various injection cycles and stages, is a critical necessity that permits analysis of the size and nature of the stimulated zone, permitting design decisions and operational procedures for subsequent cycles or stages to be made. FIG. 13 depicts assessment of formation response to improve design and process control during all stages of the present method including wellbore logging during slurry injection 100, measuring bottom hole pressure as well as wellhead pressure 102, pressure sensing on the wellbore 104, offset $\Delta p$ monitoring wells 106, geophones 108 and pressure gauges 110 in order to measure volume change $\Delta V$ in the target zone. FIG. 14 depicts a deformation measurement array including surface $\Delta\theta$ tiltmeters 112, shallow $\Delta\theta$ tiltmeters 114 and deep $\Delta\theta$ tiltmeters 116 as well as $\Delta z$ surface surveys, satellite imagery and aerial photography of the surface 120 in order to measure volume change $\Delta V$ in the target zone 94.

Figure 15A:
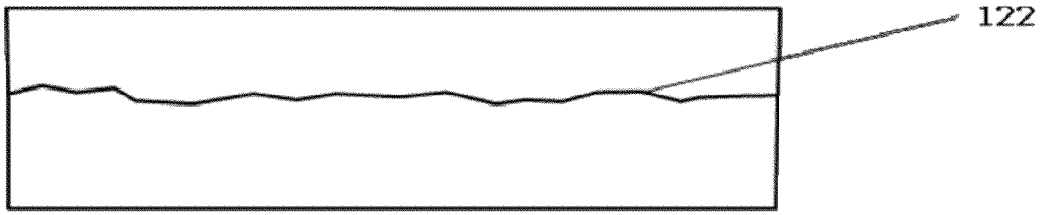
FIGS. 15A through 15C are further schematic cross-sectional configurations of a formation showing an embodiment of the invention.
Figure 15B:
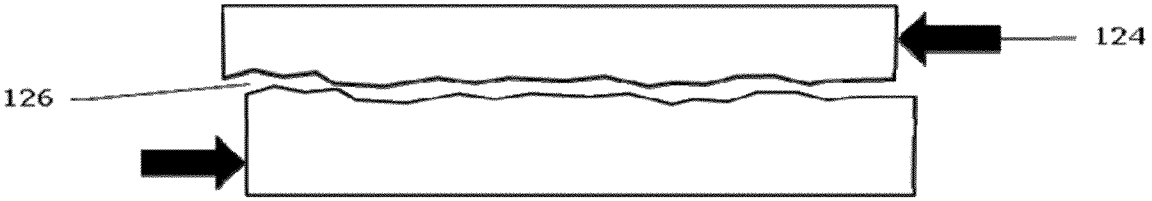
Figure 15C:
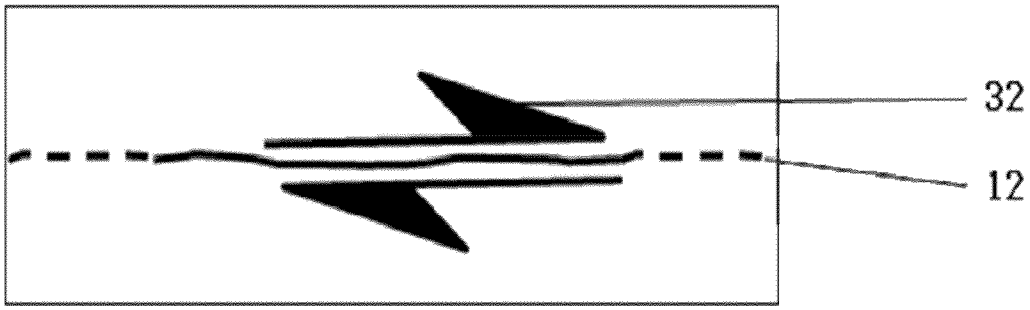

FIG. 15A is a depiction of a cross-section of an individual naturally existing fracture plane 122 that is closed, similar to the myriad of fractures shown in FIG. 1. FIG. 15B is a depiction of shear displacement 124, whereby shear propagates the fracture, incipient fractures open and mismatch occurs that leads to a permanently dilated and flow enhanced fracture 126. This is a depiction of the processes that occur during shear 32 of natural fractures 10 shown in FIGS. 6, 7, 8 10 and 11. FIG. 15C depicts extension of a fracture so that an incipient fracture 12 is also subjected to shearing, thereby experiencing displacement and dilation, leading to a large increase in permeability. A major goal of the present process of stages of injection with careful evaluation of the effect of the stages and numerous cycles is to increase the efficacy of the fracturing process to enhance the shear dilation and fracture opening through judicious alteration of the processes during the active fracturing operations and between injection cycles, based on analysis of the collected information.

Figure 16A:
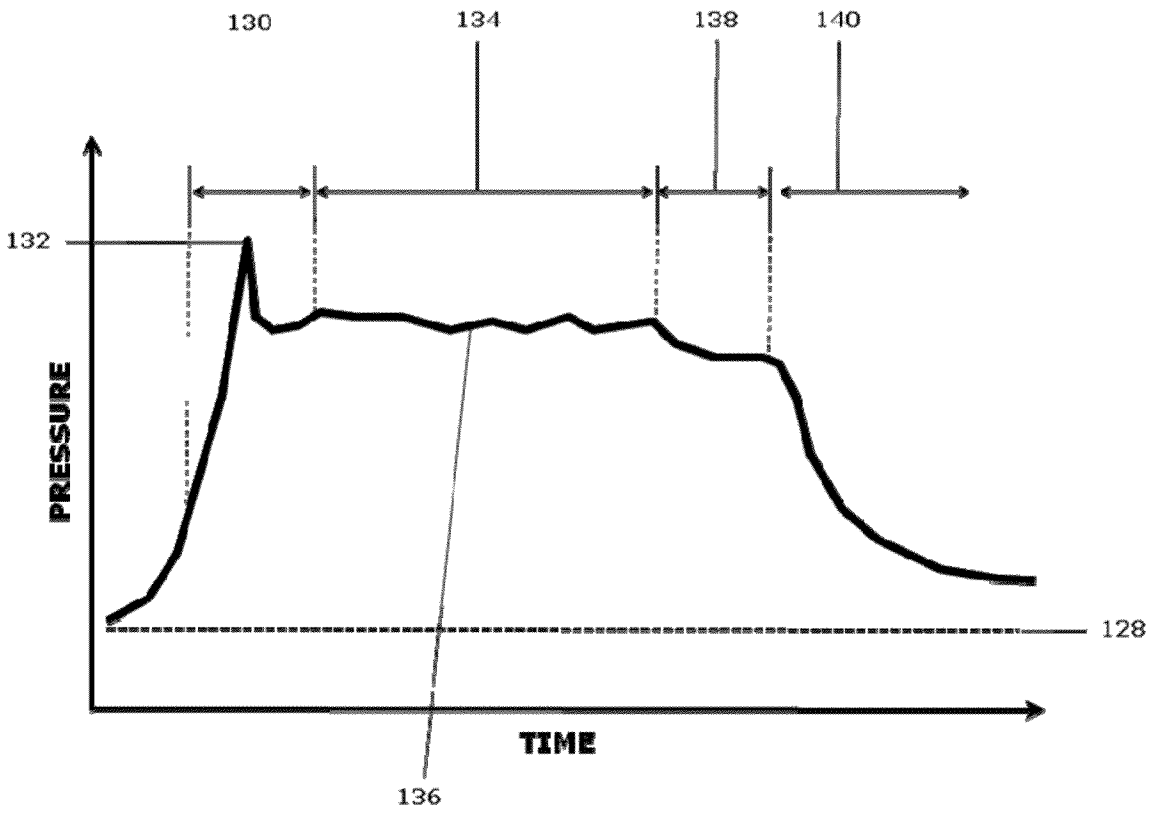
FIGS. 16A, 16B and 17 are graphs depicting the operation of an embodiment of the present method.
Figure 16B:
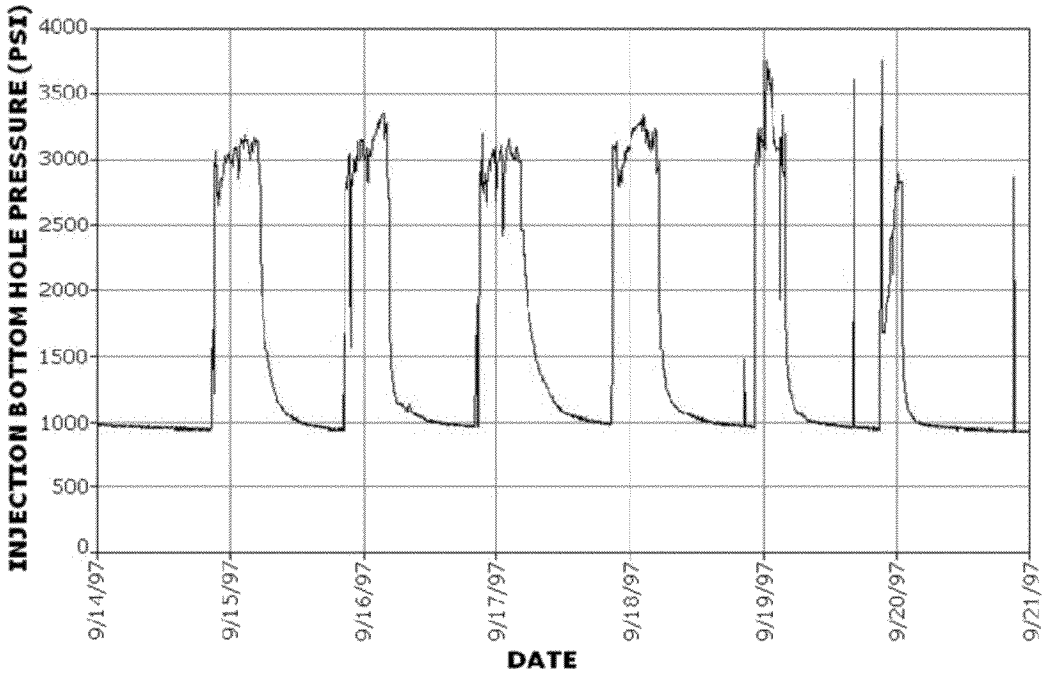
Figure 17:
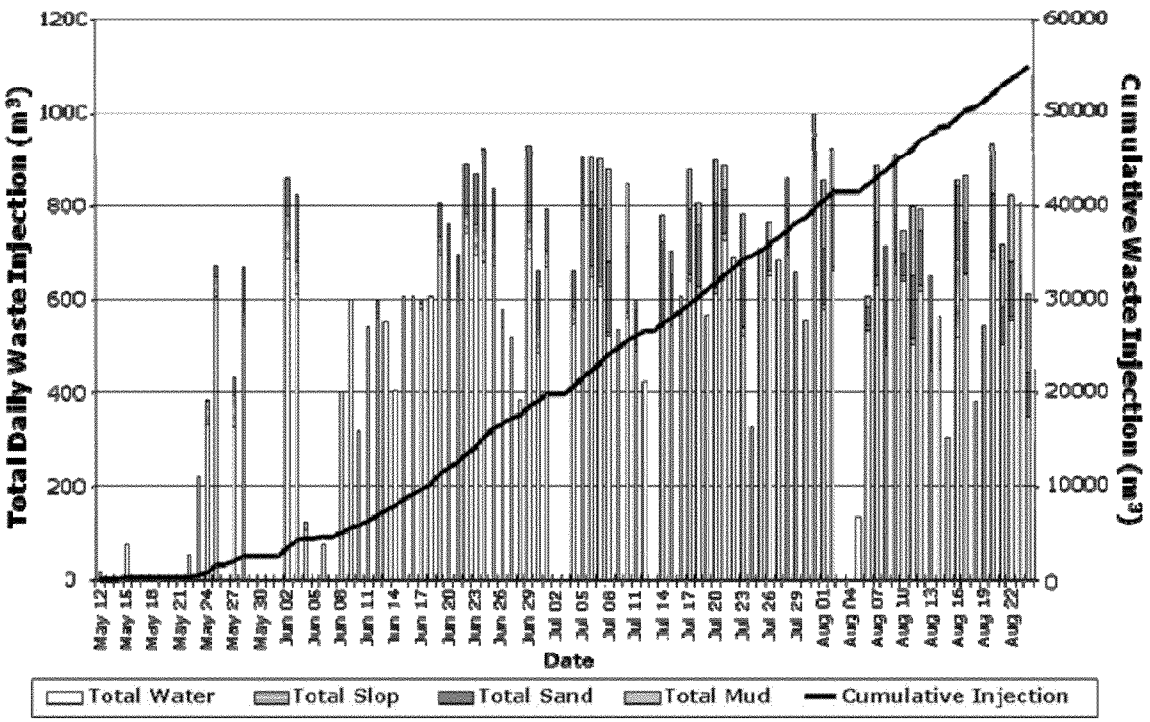

FIGS. 16 and 17 are graphs depicting the application of multiple cycles of the injection stages of the method described herein and data collected during waste sand injection into high permeability sandstones for purposes of waste disposal. FIG. 16A depicts the daily cycle of the SFI™ process that increases pressure above the formation pressure 128 including the water injection phase 130, the injection start-up 132, the sand injection phase 134 leading to propagation pressure 136, a further water injection phase 138 and a pressure decay period 140. FIG. 16B depicts multiple day cycles which confirms that long-term SFI™ injection of sand-water slurry may be sustained. The SFI™ process may be sustained over, but is not limited to, a period of months FIG. 17. FIGS. 16 and 17 depict that the method described herein is capable of fracture re-initiation, cessation, re-starting, and so on, during the course of a prolonged stimulation process involving many days and many cycles. The method described herein can include the steps of ceasing injection occasionally to evaluate the progress of the process, and changing the design and the nature of the operation for subsequent cycles and stages as required to reach an economical and efficient stimulation of the region around the wellbore 36 in a low-permeability stiff rock mass containing a myriad of natural fractures 10.

Figure 18:
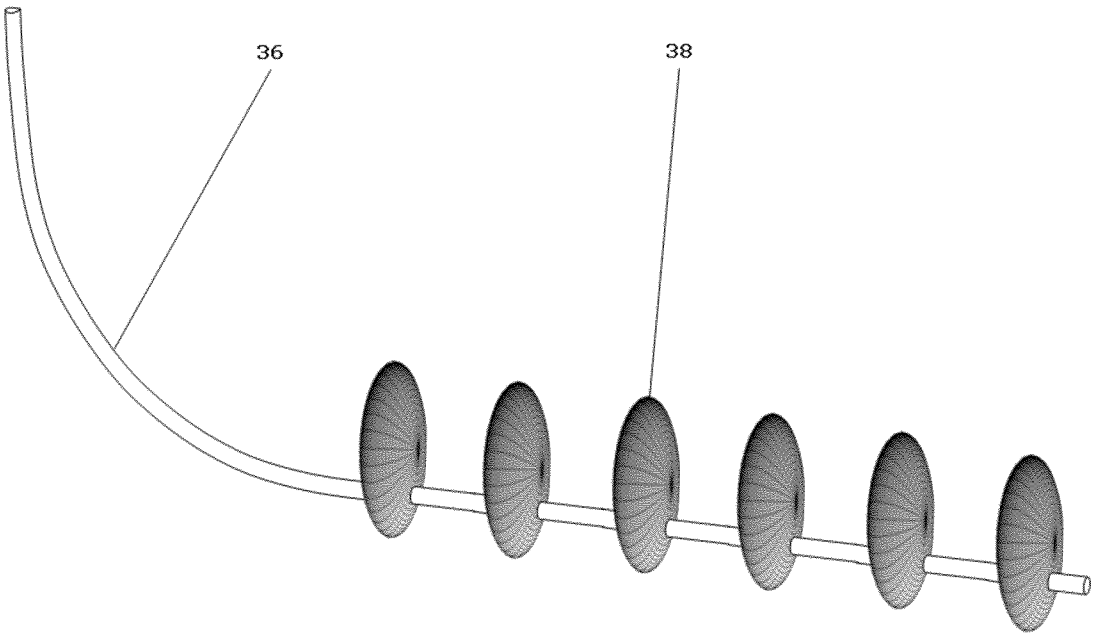
FIG. 18 is a schematic depiction of a plurality of stimulated regions within a formation according to an embodiment of the invention.

FIG. 18 is a depiction of a plurality of stimulated regions 38 within a formation distributed along an wellbore 36, wherein the naturally-occurring fracture network has been enhanced, expanded and enlarged by application of the process and methods described herein.

The present method may be practiced in a geographic region in which an oil or gas-bearing shale formation exists in a relatively deeply buried state. The present method entails the generation of an enhanced network of relatively small fractures occurring naturally within the formation and the opening and extension of incipient natural fractures into the dilated zone 38 FIG. 11, combined with and surrounding an induced secondary fracture network propped with sand 70 and 72 (FIG. 11). The present method may be contrasted with prior art processes involving massive large scale fracturing of the formation. The present method may utilize the natural fracture 10 network within the formation as an element in developing an extensive conductive fracture network for the production of hydrocarbons, and this element can be stimulated to an efficient state through implementation of a number of stages and cycles that are designed and implemented based on the results of a number of measurements such as the PFOT, SRT, deformation, and microseismic emissions field.

Stage 1, as depicted in FIGS. 4 and 5, is the provision of one or more wellbores 36, vertical or horizontal, arranged to provide access to the target formation at one or more locations along the injection well 19 or wells. In one possible configuration, as depicted in FIG. 4, wellbores 36 are sunk and as the target formation is approached, the wellbores 36 are deviated to form long horizontal segments in the target formation. A steel casing is lowered into the well and cemented in the standard manner described by prior art. Along the length of the horizontal well, specific locations are identified and openings are created through perforating the steel casing to allow access to the formation. The perforated site 25 can be approximately 2-3 m long and once perforated can contain no less than 50 openings of diameter no less than 18 mm. A number of similar horizontal wells may be drilled into the target formation, either parallel to each other, as depicted in FIG. 5, or in some other disposition, such as combining horizontal, vertical and inclined wells, deemed sufficient to contact the formation at the desired spacing. These wellbores 36 are also equipped with cemented steel casing and perforated to gain access to the strata behind the cemented casing. FIG. 5 depicts an essentially horizontal or gently dipping injection array installed within a generally horizontal or gently dipping shale formation or other low permeability formation. It will be evident that a suitable target formation may also be disposed in tilted or curved orientation, and the field of injection wells may be likewise disposed in a tilted and/or curved plane. Typically, the rows of injection wells may be spaced between 50 and 500 meters apart as indicated in FIG. 4, although the inter-row spacing will vary depending on the characteristics of the formation and other factors. FIG. 4 illustrates in detail a horizontal injection segment of two well bores 36, which may include in one embodiment as many as 45 zones of perforated openings along its length, each length of perforations constituting a site to be employed for the generation of a corresponding fracture stimulation zone within the formation.

One or more of the completed injection well perforated sites 25 is isolated from the rest of the well and then is fed first with pressurized water and later with a water and sand slurry for inducing fracturing within the shale formation. As will be described below, the water or water and sand slurry is fed into the injection well 19 in a designed sequential fashion. The source or sources of slurry may comprise any suitable mechanical system capable of generating a pressurized aqueous slurry with sand or other particulate matter as a fracture proppant and suitable additives on demand and for selected periods. Any suitable source of water may be used for injection or to mix with proppant and additives to make a slurry, including surface water, sea water, or water that was previously produced along with oil or natural gas, on the condition that the water is free of minerals or particles that could impair the ability of the shale to produce the hydrocarbons present in the natural fractures 10 and pore space. If deemed necessary by geochemical analysis or other studies, such water may be treated chemically so as to avoid any deleterious reactions with the natural water and minerals in the formation to be stimulated.

The present method comprises a staged approach to the generation of an extensive conductive and interconnected fracture network within the formation surrounding the wellbore 36 in order to facilitate and accelerate the extraction of hydrocarbons or thermal energy. The entire process is applied at one perforated site 250 along the wellbore 36 and in a series of designed stages, before moving to another perforated site 25 along the same or another wellbore 36. Once the hydraulic fracture stimulation process is completed at that perforated site 25, another perforated site 25 along the wellbore 36 is isolated, and the process is repeated at the new perforated site 25, modified as necessary to account for the effects of previous stimulations along the wellbore 36. This sequential and staged stimulation of a number of perforated sites 25 along the wellbore 36 continues until all of the perforated sites 25 have been appropriately stimulated, then a new wellbore 36 may be treated.

Prior to commencing the injection stages at a specific perforated site 25 along the wellbore 36, a SRT, a stepped-rate fracture pressure assessment is performed. This procedure entails commencing injection of clear water as described above, without additives or particulate matter, at a low but constant injection rate while measuring the pressure response of the water being injected. The initial value of the injection rate is typically on the order of 0.25 to 1.0 bpm, and typically a time period of from 5 minutes to one hour is permitted to allow the injection pressures to approximately achieve a constant value. Then, without ceasing the injection process or altering any other conditions, the injection rate is increased by the same amount, on the order of 0.25-1.0 bpm, and the pressure is once again allowed to equilibrate. The injection rate and the pressures of injection are plotted on a graph in such a manner as to permit the operator to determine at which injection rate and pressure a substantial hydraulic fracture was generated at the injection site. This information is also used to assess the value of the minimum fracturing pressure, and is thence used in the design of the subsequent hydraulic fracturing process stages. In particular, an injection rate that is somewhat above the minimum fracturing pressure will be specifically chosen to conduct the fracture stimulation initially, and a higher or lower rate may be used thereafter, in cycles if required, depending on the effects measured by the monitoring. Furthermore, the SRT may be repeated during the hydraulic fracture stimulation process described below in order to evaluate stress changes and injectivity changes in the target formation and thereby gather more data that can help to alter and re-design the injection strategy to achieve optimum results.

Stage 1—Enhancement of the Natural Fracture System

Stage 1 comprises relatively longer injection times and lower fracture injection rates compared to prior art fracturing processes for water-generated hydraulic fracture stimulation of the target formation at and around the selected perforated site 25 of a wellbore 36. In the preferred embodiment, the injected water preferably contains no additives and no particulate matter, and it thereby has the effect of increasing the pore pressure within the formation and thus extending enhanced hydraulic fracturing stimulation effects on the native fractures 10 and incipient fractures 12 as far out as possible into the formation from the perforated site 25. This increase in pore pressure in a formation that is acted upon by the naturally existing stresses in the earth triggers an increase in both the natural fracture aperture width and a shear dilation effect that leads to self-propping FIGS. 8, 15. The water injection pressure is above the minimum natural stress in the ground, and this causes a hydraulic pressure induced opening of the natural fractures to form open natural fractures 69. Under continued injection, this process of opening the natural fractures will propagate beyond the immediate vicinity of the injection well 19 outward into the formation. The long term, high pressure and high rate of water injection interacts with natural fracture 10 system in a number of ways. First, it acts to hydraulically connect a myriad of natural fractures 10 together i.e., establish hydraulic communication between the fractures, creating an interconnected pathway network to the injection well 19. Second, the high pressure acts to open natural fractures 10 and incipient fractures 12 as the rock mass seeks to accommodate itself to the large volume rates of injection and the changes in the effective stresses, and part of the opening of these natural fractures 10 and incipient fractures 12 is permanent in nature, leading to permanent high permeability paths connecting to the injection well 19. Third, as depicted in FIG. 6A, it is also indicated that appropriately oriented natural fractures 10 will undergo shear displacement under conditions of high pore pressures due to the high rate of injection. The high pressures facilitate the opening and shear displacement of the natural fractures 10 to form open natural fractures 69, as depicted in FIGS. 6, 7, 8, 10 and 11, so that the opposing surfaces no longer close fully or match perfectly upon closure, leaving a remnant high permeability channel because of the shear displacement and dilation, as depicted in FIG. 15. This latter process of shear displacement and permanent dilation of the natural fracture 10 network is referred to as self-propping, and it leaves a remnant network of high permeability channels interconnected with the hydraulically induced fractures that facilitate the flow of oil and gas to the production wellbore. It is part of the present method to continue to inject clear water aggressively so that the process propagates outward from the injection point and creates a large volume of interconnected and opened natural fractures 69 that form an extensive drainage area around the injection point through the mechanisms described herein. In some cases such as when the target formation consists of swelling shale or other geochemically sensitive rock, brine or other salt solution can be used to inhibit swelling. In general, the use of gels and other agents should be avoided or minimized, since most such agents deposit a residue within the formation and reduce the natural permeability of the rock or partially block the flow paths of the induced and stimulated fracture network. Caution is exercised so as to ensure that the injected fluid is compatible with the target formation rock. For example, saline solutions can potentially affect the wettability of the rock. As well, if this solution is too acidic, this may tend to make the rock more oil wet, whereas if the solution is salt-free and too basic high pH, it can facilitate the swelling of clay minerals in the shale that are susceptible to chemical effects. It is contemplated that the injection liquid will consist of any liquid varying from fresh water to saturated sodium chloride brine with a pH controlled value of about 6.0 to 7.0, or approximately of neutral acid/base nature.

The specific time length of the water fracturing is variable depending on the characteristics of the natural fracture 10 network and their response to the injection process. Stage 1 consists of a single or several prolonged injection episodes and their duration and characteristics rate, pressure, time period, shut-in period, flowback period, additives may be determined with various types of well testing, deformation measurements, microseismic emission measurements, or a combination of these methods. Specifically, the stage 1 process involving aggressive water injection can be continued, optionally using a number of cycles of varying lengths, until the process has closely attained the maximum possible stimulated volume around the injection location. In the use of deformation data, high precision inclinometers i.e., 112, 114 or other appropriate devices can be used to measure the deformation of the rocks and the surface of the earth in response to the high rate injection of water. The amount of volume increase and its spatial distribution are mathematically analyzed as injection continues, allowing a determination to be made as to when the injection can be ceased. For example, when the deformation data show that there is no longer a significant increase in the volume of rock that is undergoing dilation around the injection site, one may cease injection. Similarly, microseismic emissions may be studied in a similar manner; the number, location, nature and amplitude of the emissions, each of which represents a shearing event around the injection location, are mapped and studied as the injection continues. Because each shearing event detected through the use of microseismic monitoring is associated with a shear displacement episode, active monitoring and mapping of these events is akin to mapping the propagation and extent of the zone where shearing and self-propping are occurring. For example, once the outward propagation rate of microseismic events slows down sufficiently so that it is apparent that further injection can have at best a marginal benefit on the volume of the stimulated zone, one may cease injection. Once injection during stage 1 has ceased, or if it is desired to perform an evaluation of the injected zone during the progress of the stage 1 water injection, the effect of the stimulation of the injection zone can be evaluated by measuring the rate of pressure decay 140 without allowing water flowback PFOT, or by the change of rate and volume of flowback if the well is allowed to flow, or by the use of specific pressurization or injection tests such as a SRT carried out to specifically assess the extent and nature of the region around the wellbore 36 that has been affected by the stage 1 injection process. If the well test results described in the previous sentence indicate that further benefit could be achieved through continuing injection, the stage 1 water injection is re-initiated and continued until there is a reasonable certainty that a stimulation close to the maximum achievable has been attained for the conditions at the site. Alternatively, a suitable duration for stage 1 is between 4 and 72 hours. As described, stage 1 may be repeated for a number of cycles, either upon concluding the initial stage 1, or upon concluding a subsequent stage in the multi-stage hydraulic fracture cycling process described below.

Optionally, at the end of the first injection cycle but not after subsequent stage 1 injections, the well can be shut in for approximately a 12 hour period to measure the decay rate at the bottom hole pressure. This PFOT assesses the behaviour of the shut-in well and will provide a quantitative assessment of the enhancement of the natural fracture system in terms of permeability fracture conductivity or transmissivity change, radius or volume of change, and the development or improvements of the fluid flow behaviour and components around the injection location linear flow, bilinear flow, radial flow, boundary condition effects, etc. This formation response information is essential to refining and improving on the stage 1 injection strategy, as well as to aid in designing and implementing the injection characteristics for the proppant slurry for stage 2. There are a number of alternatives to the pressure fall-off measurements, and several are delineated. One possibility for the evaluation of the volume and nature of the stimulated zone is, after the stage 1 injection, to allow the well to flow-back under a constant stipulated back pressure. The rate of water flow is measured over time until flow-back has almost ceased, then the back pressure in the well is dropped and the renewed flow-back is monitored carefully. The process is repeated and the results analyzed. Another alternative approach to evaluating the effect of the stage 1 stimulation is to execute one or more of a variety of injection tests and pressurization-decay tests SRT, PFOT or modifications thereto that are described in prior art, and that may also be monitored at the same time for deformation and for microseismic emissions.

Stage 2—Propping of the Natural Fracture System

Stage 2 may be commenced immediately or shortly after the conclusion of the final part of stage 1, or without any substantial break in the injection process if so decided by previous analysis and evaluation, but usually after an extended PFOT. Stage 2 comprises the injection of slurry comprising water and a fine-grained proppant, for example a 100-mesh quartz sand proppant. A suitable particle range for the fine-grained particulate material is from 50 to 250 microns 0.002 to 0.01 inches in grain diameter. The injection rate is relatively modest during stage 2 and can vary widely depending on equipment, depth, stress and so on, but is generally in the range of 3-8 bpm. The objective of stage 2 is to introduce the fine-grained sand/particles and have them move far out into the formation, so as to prop open the apertures generated in stage 1 through filling the apertures of opened natural fractures 69 and enhanced natural fractures with the particular matter. Stage 2 thus corresponds with FIG. 9A, and the details of the effects at the leading sand tips 78 are depicted in FIG. 8C. This process also engenders further volume change through opening of the natural fractures 10 to form opened natural fractures 69 that enhances the shearing and the interconnected nature of the natural fracture 10 network, as enhanced because of the elevated pore pressures implemented in stage 1. Under these conditions, the sand within the slurry is disbursed far out into the formation to prop open the generated apertures in the natural fracture 10 network, and to enhance the shearing, maintenance and extension of the enhanced natural fracture network generated in stage 1.

Stage 2 may comprise multiple cycles consisting of discrete sand injection episodes, perhaps of different concentrations, each of which is followed by a PFOT, preferably for at least 12 hours but as much as 20 hours or more, prior to commencing the next sand injection episode. The PFOT results are analyzed mathematically to help decide the proppant concentration and injection rate and time length for the next cycle. Typically, once injection of water with a particulate propping material is commenced, one should not allow fluid flow-back into the injection well 19 as this may plug the well. For each of the fall-off periods the pressure data for the wellbore 36 is collected to a sufficient precision so that the operations personnel may analyze the pressure change with time $\Delta p/\Delta t$ in a consistent manner to allow a consistent PFOT interpretation permitting the continued evaluation of the stimulation process.

Each sand fracture episode commences with injection of clear water at a constant volume rate. Specific protocols for the injection rates may be provided, using the same value for each episode, and measuring the pressure build-up during the placement of a pre-slurry water pad over a 15 to 30 minute period. If this step is done consistently, it can also be analyzed consistently, giving confirmatory information about the changes in effective transmissivity and to a lesser degree the extent of the flow zone around the well. This is another measure used along with the others to execute the on-going process design.

After the fine-grained proppant enhancement of the natural fracture system is generated through the above steps which may consist of many cycles of proppant injection, fall-off periods and clear water injection, a shut-in period of, preferably, no less than 12 hours is performed to assess the formation flow conditions and changes from the 12 hour shut-in after the baseline PFOT in stage 1, including the decay rate of the pressure. This is analyzed with one or more methods, including multiple circumferential zones of different permeability, as well as a classical fracture wing length analysis. The PFOT analyses of the shut in data provides a quantitative assessment of the 'enhancement' of the natural fracture 10 system in terms of permeability fracture conductivity change, radius of volume change leading to conductivity improvements, and the development and improvements in the fluid flow components over time once injection is ceased linear flow, bilinear flow, radial flow, boundary condition effects, etc.

The formation response information generated in the above steps is useful for refining and improving on the stage 2 injection strategy and also for the design and stipulation of the injection strategy and proppant characteristics for the subsequent stage 3 injection activity.

Stage 3—Creating a Large Induced Fracture System as a Secondary Flow System

One or more episodes of stage 3 are conducted to create or induce a large fracture system that is in suitable hydraulic communication with the induced fractures and the enhanced natural fracture system developed in stages 1-2. The SFI™ process allows for a large fracture system to be created by propagating a series of fracturing events in a controlled manner with good volumetric sweep of the formation in the near-wellbore area out into the formation—not with the use of a massive single fracture with large dimensions great height and great length, which is often the goal that is stipulated in prior art.

It is preferable to allow the stage 2 fracturing process to 'stabilize' before proceeding with stage 3. In most cases, after a relatively prolonged shut-in period following stage 2, the final injection comprising stage 3 using a coarse-grained sand or particulate proppant material can be implemented. In some applications, the sand may constitute a 16-32 sand or 20-40 quartz sand proppant, and in any case may be a sand of grain diameter in the range of 200 to 2000 microns, comprising medium-grained to coarse-grained sand classification sizes. However, the type of proppant in this stage is not critical, providing it is a relatively strong and reasonably rigid granular material that preferably consists entirely of moderately to well-rounded grains. One aspect of this stage is that the associated fracture water pads pre- and post-fracture water injection periods are carefully done in a consistent manner with full pressure and rate measurements so as to reduce the chances of plugging the injection well and to improve the chances of analyzing the data in a useful manner.

Issues that can be addressed in order to ensure an optimal proppant design for the stage 3 induced fracture system include:

i. fracture propping issues—the nature of the pressure-time-propping process that leads to induced fractures 11 of wide aperture, with the success being linked to the width of the near-wellbore induced fractures 11 and to the degree of interconnectedness of the induced fractures 11 and the natural fractures 10. In this case, FIG. 9B and FIG. 10 depict the desired effect of stage 3, with shorter, wider fractures containing coarse-grained sand being created relatively close to the wellbore 36 and connecting with the stimulated networks beyond, generated during stages 1 and 2.

ii. placement issues—the success of the sand placement process in terms of the consistency of sand placement far into the induced and enhanced natural fracture system.

iii. conductivity issues—the magnitude and extent of the improvement of flow capacity of the region around the treatment point as the result of the combination of the enhanced natural and incipient fracture through aperture propping, shear displacement and self-propping, and interconnection with the hydraulically induced fractures and the wellbore 36.

iv. in situ stress changes—the changes in the fracturing pressure in the near-wellbore vicinity as measured by step-rate tests, or as estimated by fracture flow-back or PFOTs. Specifically, the significant additional volume change implemented during Stage 3 will have effects on formation stresses that are a function of the magnitude of the volume change in the region nearer to the wellbore 36; and controlling and optimizing this volume-stress change in order to facilitate stress rotations and fracture rotations is a critical factor in the present process.

The coarse-grained sand in stage 3 should be injected more aggressively than the fine-grained sand of stage 2, and in general a higher injection rate of 5 bpm or more, and as high as 10 bpm or more, if the physical facilities so permit, may be employed so as to avoid any premature blockages and to establish a good hydraulic communication with the enhanced network generated in stages 1 and 2.

Before and during stage 3, the pressure monitoring and other monitoring steps associated with stages 1 and 2 are continued and repeated in essentially the same manner pre-fracture pad, and post-fracture shut-in to permit a comparison of the formation responses between stages 2 and 3. Once sand placement is finished, one may repeat the PFOT analysis of the post-fracture stage for a minimum of 12 hours, although one may extend the shut in period for a longer time to allow the effect of the more remote propped fractures to be assessed.

Once the pressure decay data has been collected, a SRT stress measurement may be performed after the last active injection before full flow-back and attempting to bring the well on production.

Using the SFI™ process during stage 3, the volume of sand pumped during the various stages can be more important than the concentration of sand pumped i.e., the rate at which the sand is placed, and one can inject more sand volume with longer periods of injection time at lower sand concentrations. Specific values of sand proppant concentration and injection rate during stages 2 and 3 are determined through consistent analysis of the data collected during the treatment process starting from the initial step-rate tests carried out before stage 1, and including all data subsequent to that test.

Cycling of Stages

The present method may comprise repeated cycles and/or subcycles, which may consist of the following:

1. repetition of any individual stage before proceeding to the next stage;

2. sequentially repeating any two stages, before proceeding to the next stage, for example stages 1 and 2 may be repeated in sequence multiple times, before proceeding to stage 3, or stages 2 and 3 may be repeated multiple times before concluding the process or proceeding back to stage 1;

3. sequentially repeating all 3 stages, for a selected multiple number of times.

4. Changing the parameters or extents of the injection or shut-in periods.

Stages 1 through 3 are collectively considered a complete "fracture cycle". In one embodiment, a shut-in time is provided between repetitions of the fracture cycle. In one embodiment, the shut-in time is at least 24 hours. This shut-in period allows for one or more of the following:

i. In situ stress redistribution/stabilization.

ii. Facilitation of fracture rotation.

iii. Evaluation of PFOT to assess improvement in overall formation permeability.

iv. Maximizing or managing formation shear stress development which can lead to shear movements in shale and subsequent improvements in self-propping activity.

Minimizing large-scale shear stress concentrations along interfaces that may have a possible impact on wellbore integrity, especially for vertical wells that are prone to shear along horizontal geological interfaces.

The shut-in time between cycles can be based on the following parameters:

i. Volume of sand pumped ii. Duration of pumping iii. PFOT characteristics of the formation The stages can be repeated within a cycle as necessary depending on the results of the fracture enhancements. For example, several sub-cycles of stage 1 and 2 may be applied for effective enhancement and propping the natural fracture network. The entire cycle can be repeated stages 1-3 to effectively develop a large hydraulic communication and drainage area that develops from the wellbore 36 out into the formation in a controlled manner.

It may also be desirable to increase the concentration of the proppant at the end of last stage 3 to 'pack-off' the wellbore 36 area in order to create a highly conductive path around the wellbore 36 allowing for good flow from all flow systems into the wellbore 36. In prior art this process has been referred to as "forced fracture tip screen-out" or "frac-'n-pack".

The injection strategy with each additional stage/cycle may vary as the number of cycles increases. For example, a coarse-grained proppant 20-40 may be used in stage 3 during the initial cycles. The proppant may change to 60-40 for stage 3 in later cycles. A coarse-grained sand may be used for stage 2 in subsequent cycles, compared to the first cycle in the sequence of stage 2.

The application of SFI™ in the form of repeated cycles and stages as described herein carries sand deeply into the formation. Sand deposits within the formation cause increases in local formation stresses with each cycle. Local formation stresses of this nature cause reorientation of new fractures generated in a subsequent cycle when opening of natural fractures 10 is re-initiated through the use of high pressure slurry injection, resulting in the fracture rotation illustrated schematically in FIGS. 9 and 10.

FIGS. 8 and 11 depict the consequences of a typical fracture stimulated zone—the overall dilated zone 38, some of it sand propped, some not, resulting from the present process. The stimulated zone formation has a high permeability and approximately a lenticular or ellipsoidal shape, the region of which adjacent to the injection site comprises a sand zone 70 and 72 combined and the exterior region a dilated stimulated zone. This interior zone that contains proppant, together with more distal portions outside the sand zone, constitutes a large volume dilated zone arising out of application of the present method. This zone in its entirety has enhanced flow properties, resulting from the dilated natural fractures, as well as the connection and opening of the aperture of intersecting pre-existing fissures and fractures as a result of the influx of water and the introduction of a sand proppant. Additionally, the natural fractures 10 and incipient fractures 12 can shear and dilate under the effects of the proposed method, and even if not physically opening, they can be displaced as the result of large shearing stresses and elevated pore pressures. Such fractures will not likely close when $\Delta p$ equals 0, although such fractures that are not propped open may still be sensitive to changes during hydrocarbon depletion.

FIG. 12 depicts an individual injection wellbore 36, showing the manner in which the open hydraulically induced fracture may rise out of the immediate injection zone generated at the injection site if the conditions so permit, but with the sand being retarded and staying in the target zone 94. This present process also claims to restrict the rise of the sand proppant by virtue of using only low-viscosity water as a liquid agent to affect the opening of the natural fracture 10 network. FIG. 13 schematically shows one approach to monitoring formation response to the injection process described herein. The monitoring response comprises any combination of pressure sensors located on the injection well 19 and injection system, surface $\Delta\theta$ tiltmeters 112, shallow $\Delta\theta$ tiltmeters 114 and deep $\Delta\theta$ tiltmeters 116 located at increasing distances from the injection well 19, and microseismic sensors comprising geophones 108 or accelerometers that can collect vibrational energy emissions arising from stick-slip shear displacements in the rock mass. An offset $\Delta p$ monitoring wells 106 may be positioned remotely from the injection well 19, at a distance which is distant from the expected dilated zone 38 within the formation. The offset $\Delta p$ monitoring wells 106 comprises geophones 108, accelerometers, and pressure gauges 110 located strategically along the length of the said monitoring well 106, for detecting changes in pressure within the formation, and for collecting vibrational energy responses. The instrumentation in the monitor well 106 or wells can also detect changes in pressure resulting from fracture fluid down-gradient leak-off 24 of injection fluid from the injection well 19.

FIG. 14 depicts deformation monitoring techniques, comprising an array of shallow $\Delta\theta$ tiltmeters 114 and deep $\Delta\theta$ tiltmeters 116 located at varying distances from the injection well 19, intended to detect changes in the deformation fields associated with the volume changes induced in the hydrocarbon reservoir. The wells can comprise means to detect displacement of the formation to an accuracy sufficient to analyse the data and determine the aspect and magnitude of the induced dilation of the natural fracture 10 system. In addition, various surface surveys may be conducted to detect surface level changes, including surface surveys, satellite imagery and aerial photography 120.

FIGS. 16 and 17 depict the changes in bottom-hole pressure that occur when the process is applied in a multiple cycles extending over protracted periods extending over multiple days and months.

In a further aspect, the injectate may comprise a slurry that incorporates a waste substance, such as contaminated sand or other wastes. This serves the dual purposes of enhancing hydrocarbon production, as well as a convenient means to dispose of granular operational wastes in a permanent fashion, constituting a novel approach to achieve multiple goals.

The present invention has been described herein by way of detailed descriptions of embodiments and aspects thereof. Persons skilled in the art will understand that the present invention is not limited in its scope to the particular embodiments and aspects, including individual steps, processes, components, and the like. The present invention is best understood by reference to this patent specification as a whole, including the claims thereof, and including certain functional or mechanical equivalents and substitutions of elements described herein.

The invention claimed is:

1. A method of generating an extended fracture network in a rock formation, said formation characterized by a network of native fractures and incipient fractures and a minimum hydraulic fracturing pressure and rate whereby fluid injected at a higher rate and pressure causes the formation to fracture, said method comprising the sequential steps of i) injecting a non-slurry aqueous solution into the formation at a pressure and rate which is slightly above the minimum hydraulic fracturing pressure and rate whereby a zone of essentially self-propping fractures is generated by increased pore pressure, shearing, and dilation of the native fractures and incipient fractures, and wherein said step (i) is performed until the maximum possible stimulated volume of the formation has been substantially attained for a given injection site as determined by formation response measurement data;

ii) injecting a plurality of slurries comprising a carrying fluid and sequentially larger-grained granular proppants into said formation whereby said steps i and ii generate an inner zone of fractures that are propped with said granular proppant and at least some of the fractures therein are widened, and an outer zone surrounding the inner zone essentially comprising self-propped fractures; and iii) further extending and propagating the outer zone by additional injection of non-slurry aqueous solution into the formation at a pressure and rate slightly above the minimum hydraulic fracturing pressure and rate.

2. The method of claim 1 wherein said steps ii and/or iii further comprising controlling and optimizing formation volume resulting from steps ii and/or iii in order to facilitate stress rotations and fracture rotations.

3. The method of claim 1 for extraction of one or more of crude oil, hydrocarbon gas or geothermal energy.

4. The method of claim 1 wherein said formation has a permeability of less than 10 milliDarcy.

5. The method of claim 1 wherein said aqueous non-slurry solution comprises water or saline that is essentially free of additives.

6. The method of claim 1 wherein step ii further comprises a sequence of discrete water injection episodes separated by episodes of injection of said proppant.

7. A method of generating an extended fracture network in a rock formation, said formation being characterized by a network of native fractures and incipient fractures and a minimum hydraulic fracturing pressure and rate whereby fluid injected at a higher rate and pressure causes the formation to fracture, said method comprising:

Stage 1: injecting a non-slurry aqueous solution into said formation slightly above the minimum hydraulic fracturing pressure and rate whereby a zone of self-propping fractures is generated by increased pore pressure, shearing and dilation of the native fractures and incipient fractures, wherein said stage 1 is performed until the maximum possible stimulated volume of the formation has been substantially attained as determined by formation response measurement data;

Stage 2: injecting a first slurry comprising a carrying fluid and a fine-grained granular proppant into said formation whereby said stage 2 generates an inner zone within the zone generated in stage 1 wherein fractures are propped with said fine-grained granular proppant; and Stage 3: injecting a second slurry comprising a coarse-grained proppant having a coarser grain than said fine-grained proppant into said formation, whereby at least a portion of the fractures within the inner zone are widened and propped with said coarse-grained proppant wherein said inner zone is surrounded by an outer zone comprising essentially self-propped fractures generated in said stage 1, said inner zone providing a pathway for additional non-slurry aqueous solution to further extend said outer zone.

8. The method of claim 7 comprising cycling sequentially for a plurality of cycles of stages 1, 2 and 3, or repeating any of stages 1, 2 or 3, or repeating any pair of stages 1, 2 or 3.

9. The method of claim 7 wherein said aqueous solution comprises water or saline that is essentially free of additives.

10. The method of claim 7 wherein stage 2 follows stage 1 with essentially no time gap.

11. The method of claim 7 wherein stage 2 and/or Stage 3 further comprises a sequence of discrete water injection episodes separated by episodes of injection of said granular or coarse-grained proppant.

12. The method of claim 7 comprising performing a plurality of cycles each comprising stages 1 through 3 and providing a shut-in period between said cycles.

13. The method of claim 7 wherein any one of stages 1-3 is repeated multiple times in sequence, or stage 1 is repeated following stage 3.

14. The method of claim 7 wherein said stages 2 and/or 3 are performed under conditions that favour generating and propagating increased volume within the formation.

15. The method of claim 7 for extraction of one or more of crude oil, hydrocarbon gas or geothermal energy.

16. The method of claim 7 wherein said formation has a permeability of less than 10 milliDarcy.

* * * * *